US006737113B2

(12) United States Patent
Leonard et al.

(10) Patent No.: US 6,737,113 B2
(45) Date of Patent: May 18, 2004

(54) METHOD FOR IMPROVING THE UNIFORMITY OF A WET COATING ON A SUBSTRATE USING PICK-AND-PLACE DEVICES

(75) Inventors: William K. Leonard, River Falls, WI (US); David W. Leonard, River Falls, WI (US); Albert E. Seaver, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 459 days.

(21) Appl. No.: 09/757,955

(22) Filed: Jan. 10, 2001

(65) Prior Publication Data

US 2002/0132049 A1 Sep. 19, 2002

(51) Int. Cl.[7] ..... B05D 1/40; B05D 3/12; B05D 5/00

(52) U.S. Cl. ..... 427/277; 427/278; 427/355; 427/359

(58) Field of Search ..... 427/256, 258, 427/270, 271, 277, 278, 286, 331, 355, 359, 428; 118/112, 118, DIG. 15, 110

(56) References Cited

U.S. PATENT DOCUMENTS

| | | | | |
|---|---|---|---|---|
| 1,043,021 A | * | 10/1912 | Mayer | 118/33 |
| 2,105,488 A | | 1/1938 | Massey et al. | |
| 2,105,981 A | | 1/1938 | Massey et al. | |

(List continued on next page.)

FOREIGN PATENT DOCUMENTS

| | | | |
|---|---|---|---|
| DE | 2304987 | | 8/1974 |
| EP | 0 047 887 | | 3/1982 |
| EP | 1 088 595 A | * | 4/2001 |

(List continued on next page.)

OTHER PUBLICATIONS

"The Coating Machine", Booth, G.L., *Pulp and Paper Manufacture,* vol. 8, *Coating, Converting and Processes,* pp. 76–87, Third Edition, 1990.

*Coating and Drying Defects,* Gutooff and Cohen, John Wiley & Sons, New York, 1995.

"Multiple Roll Systems: Steady–State Operation", D.F. Benjiman, T.J. Anderson, and L.E. Scriven, AIChEJ., V41, p. 1045, 1995.

"Multiple Roll Systems: Residence Times and Dynamic Response", D.F. Benjamin, T.J. Anderson, and L.E. Scriven, AIChEJ., V41, p. 2198, 1995.

"Evolution of Coating", by George L. Booth, Published by Gorham International Inc., Gorham, Maine, vol. 1, Dec., 1995.

*Primary Examiner*—Shrive P. Beck
*Assistant Examiner*—William Phillip Fletcher, III
(74) *Attorney, Agent, or Firm*—Brian E. Szymanski

(57) ABSTRACT

The uniformity of a wet coating on a substrate is improved by contacting the coating at a first position with the wetted surfaces of periodic pick-and-place devices, and re-contacting the coating with such wetted surfaces at positions on the substrate that are different from the first position and not periodically related to one another with respect to their distance from the first position. A coating is applied to a substrate by applying an uneven wet coating, contacting the coating at a first position with the wetted surfaces of periodic pick-and-place devices, and re-contacting the coating with such wetted surfaces at positions on the substrate that are different from the first position and not periodically related to one another with respect to their distance from the first position. These methods can provide extremely uniform coatings and extremely thin coatings, at very high rates of speed. The coatings can be applied in lanes with sharply defined edges and independently adjustable coating calipers. The pick-and-place devices facilitate drying and reduce the sensitivity of drying ovens to coating caliper surges. Equipment to carry out these methods is simple to construct, set up and operate, and can easily be adjusted to alter coating thickness and compensate for coating variation.

62 Claims, 20 Drawing Sheets

U.S. PATENT DOCUMENTS

| | | | | | |
|---|---|---|---|---|---|
| 2,229,620 | A | | 1/1941 | Bradner | |
| 2,229,621 | A | | 1/1941 | Bradner | |
| 2,237,068 | A | | 4/1941 | Bradner | |
| 2,245,045 | A | | 6/1941 | Montgomery et al. | |
| 3,018,757 | A | | 1/1962 | Loppnow | |
| 3,169,081 | A | * | 2/1965 | Nelson et al. | |
| 3,718,117 | A | | 2/1973 | Lewicki, Jr. | |
| 3,920,862 | A | | 11/1975 | Damschroder et al. | |
| 4,020,194 | A | | 4/1977 | McIntyre et al. | |
| 4,102,301 | A | * | 7/1978 | Reade et al. | 118/67 |
| 4,267,215 | A | | 5/1981 | Riggs | |
| 4,354,449 | A | | 10/1982 | Zink | |
| 4,378,390 | A | | 3/1983 | Yoshida et al. | |
| 4,569,864 | A | | 2/1986 | McIntyre | |
| 4,748,043 | A | | 5/1988 | Seaver et al. | |
| 4,830,873 | A | | 5/1989 | Benz et al. | |
| 5,326,598 | A | | 7/1994 | Seaver et al. | |
| 5,332,797 | A | | 7/1994 | Kessel et al. | |
| 5,409,732 | A | * | 4/1995 | Leonard et al. | 427/10 |
| 5,447,474 | A | | 9/1995 | Chang | |
| 5,460,120 | A | | 10/1995 | Paul et al. | |
| 5,536,314 | A | | 7/1996 | Rannestad | |
| 5,585,545 | A | | 12/1996 | Bennett et al. | |
| 5,599,602 | A | | 2/1997 | Leonard et al. | |
| 5,620,514 | A | | 4/1997 | Munter et al. | |
| 5,702,527 | A | | 12/1997 | Seaver et al. | |
| 5,733,608 | A | | 3/1998 | Kessel et al. | |
| 5,871,585 | A | | 2/1999 | Most et al. | |
| 5,954,907 | A | | 9/1999 | LaRose et al. | |
| 6,117,237 | A | | 9/2000 | Yapel et al. | |

FOREIGN PATENT DOCUMENTS

| | | | | |
|---|---|---|---|---|
| GB | 1 278 099 | | 6/1972 | |
| GB | 1278099 | * | 6/1972 | B05C/11/02 |
| WO | WO 01/96661 A1 | | 12/2001 | |

* cited by examiner

METHOD FOR IMPROVING THE UNIFORMITY OF A WET COATING ON A SUBSTRATE USING PICK-AND-PLACE DEVICES

TECHNICAL FIELD

This invention relates to devices and methods for coating substrates and for improving the uniformity of non-uniform or defective coatings.

BACKGROUND

There are many known methods and devices for coating a moving web and other fixed or moving substrates. Several are described in Booth, G. L., "The Coating Machine", *Pulp and Paper Manufacture*, Vol. 8, *Coating, Converting and Processes*, pp 76–87 (Third Edition, 1990). For example, gravure roll coaters (see, e.g. U.S. Pat. No. 5,620,514) can provide relatively thin coatings at relatively high run rates. Attainment of a desired specific average caliper usually requires several trials with gravure rolls of different patterns. Runtime factors such as variations in doctor blade pressure, coating speed, temperature, or liquid viscosity can cause overall coating weight variation and uneven localized caliper in the machine or transverse directions.

Barmarks and chatter marks are bands of light on heavy coating extending across the web. These are regarded as defects, and can be caused by factors such as vibration, flow pulsation, web speed oscillation, gap variation and roll drive oscillation. Chatter marks are commonly periodic, but barmarks can occur as the result of random system upsets. Gutoff and Cohen, *Coating and Drying Defects* (John Wiley & Sons, New York, 1995) discusses many of the sources of cross web marks and emphasizes their removal by identifying and eliminating the fundamental cause. This approach can require substantial time and effort.

Multiple lane coaters include those shown in U.S. Pat. Nos. 3,920,862; 5,599,602; 5,733,608 and 5,871,585. Gravure coating can also be used to produce down web lanes of a single formulation at a coating station, by using spaced circumferential patterns on the gravure roll or circumferential undercuts on the web back up roll. However, due to intermixing that occurs at the nip, abutting lanes of different formulations can not be applied from the same gravure roll.

Under some gravure roll coating run conditions, a gravure roll pattern appears in the wet coating. Gravure roll marks can be removed with an arcuate flexible smoothing film located down web from the gravure roll (see, e.g., U.S. Pat. No. 5,447,747); with a smoothing roll or rolls bearing against an intermediate coating roll (see, e.g., U.S. Pat. No. 4,378,390) or with a set of smoothing rolls located down web from the gravure roll (see, e.g., U.S. Pat. No. 4,267,215). In Examples 1–7 and 10 of the '215 patent, a continuous coating was applied to a plastic film and subsequently contacted by an undriven corotating stabilizing roll 68 and a set of three equal diameter counter rotating spreading rolls 70. The respective diameters of the stabilizing roll and spreading rolls are not disclosed but appear from the Drawing to stand in a 2:1 ratio. In Example 10 of the '215 patent, the applicator roll speed was increased until the uniformity of the coating applied to the web began to deteriorate (at a peripheral applicator roll speed of 0.51 m/s) and surplus coating liquid began to accumulate on the web surface upstream of the rolls 70 (at a peripheral applicator roll speed of 0.61 m/s). Coatings having thicknesses down to 1.84 micrometers were reported.

Several coaters having brush or roller smoothing devices are also shown in the above-mentioned Booth article.

Very thin coatings (e.g., about 0.1 to about 5 micrometers) can be obtained on gravure roll coaters by diluting the coating formulation with a solvent. Solvents are objectionable for health, safety, environmental and cost reasons.

Multiroll coaters (see, e.g., U.S. Pat. Nos. 2,105,488; 2,105,981; 3,018,757; 4,569,864 and 5,536,314) can also be used to provide thin coatings. Multiroll coaters are shown by Booth and are reviewed in Benjamin, D. F., T. J. Anderson, and L. E. Scriven, "Multiple Roll Systems: Steady-State Operation", AIChE J., V41, p. 1045 (1995); and Benjamin, D. F., T. J. Anderson, and L. E. Scriven, "Multiple Roll Systems: Residence Times and Dynamic Response", AIChE J., V41, p. 2198 (1995). Commercially available forward-roll transfer centers typically use a series of three to seven counter rotating rolls to transfer a coating liquid from a reservoir to a web via the rolls. These coaters can apply silicone release liner coatings at wet coating thickness as thin as about 0.5 to about 2 micrometers. The desired coating caliper and quality are obtained by artfully setting roll gaps, roll speed ratios and nipping pressures.

U.S. Pat. No. 4,569,864 describes a coating device in which a thick, continuous premetered coating is applied by an extrusion nozzle to a first rotating roll and then transferred by one or more additional rolls to a faster moving web. The extrusion nozzle is placed very close to the first roll (e.g., 25 to 50 micrometers) in order to obtain an even and smoothly distributed coating on the first roll.

U.S. Pat. No. 5,460,120 describes a coating device in which a coating is spray-applied to the underside of a moving web immediately upstream from a resilient, compressible, saturable applicator.

Electrostatic spray coating devices (see, e.g., U.S. Pat. Nos. 4,748,043; 4,830,872; 5,326,598; 5,702,527 and 5,954,907) atomize a liquid and deposit the atomized droplets assisted by electrostatic forces. In some applications the desired coating thickness is larger than the droplet diameter and the droplets just land on top of each other and coalesce to form the coating. In other applications the desired coating thickness is smaller than the droplet diameter. For these thin film coatings a solvent can be used, but if a solventless coating is desired, then the drops must land on the web some distance apart from each other in order to satisfy the small volume requirement of the thin film coating. Then the droplets must spread in order to merge into a continuous voidless coating. Spreading takes time and can be a rate-limiting step for these electrostatic spray coating processes. If the surface chemistry is such that the liquid does not sufficiently spread on the substrate in the available time before cure or hardening, then voids will remain in the coating.

SUMMARY OF THE INVENTION

The present invention provides, in one aspect, a method for improving the uniformity of a wet coating on a substrate comprising contacting the coating at a first position with wetted surface portions of:

a) three or more periodic pick-and-place devices, or b) two or more rotating periodic pick-and-place devices having the same direction of rotation and re-contacting the coating with such wetted surface portions at positions on the substrate that are different from the first position and not periodically related to one another with respect to their distance from the first position. The placement positions of the pick-and-place devices are not periodically related (that is, they are not the same or integer multiples of one another) so that their actions do not reinforce coating defects along the substrate.

The invention also provides a method for applying a coating to a substrate comprising applying to the substrate an uneven wet coating, contacting the coating at a first position with wetted surface portions of:

a) three or more periodic pick-and-place devices, or b) two or more rotating periodic pick-and-place devices having the same direction of rotation and re-contacting the coating with such wetted surface portions at positions on the substrate that are different from the first position and not periodically related to one another with respect to their distance from the first position.

In another aspect, the invention provides a method for coating at least one lane comprising at least one coating on a substrate, and for optionally abutting more than one of such lanes without substantial intermixing of the coatings in the lanes.

The invention also provides devices for carrying out such methods. In one aspect, the devices of the invention comprise an improvement station comprising two or more pick-and-place devices that can periodically contact and re-contact a wet coating at different positions on a substrate, wherein the periods of the devices are selected so that the uniformity of the coating is improved. In a preferred embodiment, the improvement station comprises three or more rolls having different rotational periods. In another aspect, the devices comprise a coating apparatus for applying an uneven (and preferably discontinuous) coating to a substrate and an improvement station comprising two or more of the above-mentioned pick-and-place devices for contacting and re-contacting the coating at different positions on the substrate whereby the coating becomes more uniform on the substrate. In yet a further aspect, the invention provides an apparatus comprising a coating station for applying an uneven (and preferably discontinuous) coating to a first substrate, an improvement station comprising two or more of the above-mentioned pick-and-place devices for contacting and re-contacting the coating at different positions on the first substrate whereby the coating becomes more uniform on such first substrate, and a transfer station for transferring the uniform coating from the first substrate to a second substrate. In a further aspect, this latter apparatus comprises a coating station that coats at least one lane on said first substrate and a transfer station that transfers such lane to said second substrate.

The methods and devices of the invention also facilitate much more rapid drying of wet coatings on a substrate. Thus in a further aspect, the methods of the invention further comprise drying the coating, and the devices of the invention include a drying station having a plurality of pick-and-place devices that contact and re-contact a substrate having an uneven wet coating, whereby the pick-and place devices increase the drying rate of the coating.

The methods of the invention can provide extremely uniform coatings and extremely thin coatings, at very high rates of speed. The devices of the invention are simple to construct, set up and operate, and can easily be adjusted to alter the coating thickness.

DETAILED DESCRIPTION OF THE INVENTION

Figure 1:
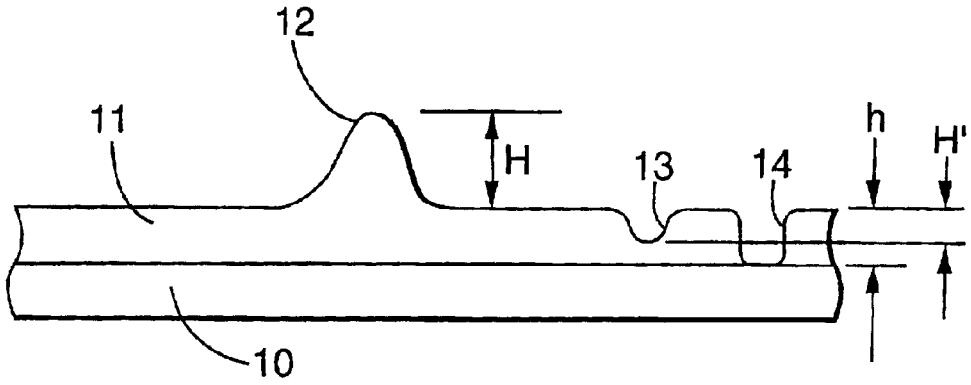
FIG. 1 is a schematic side view of coating defects on a web.

Referring to FIG. 1, a coating of liquid 11 of nominal caliper or thickness h is present on a substrate (in this instance, a continuous web) 10. If a random local spike 12 of height H above the nominal caliper is deposited for any reason, or if a random local depression (such as partial cavity 13 of depth H' below the nominal caliper or void 14 of depth h) arises for any reason, then a small length of the coated substrate will be defective and not useable. In the present invention, the coating-wetted surfaces of two or more pick-and-place improvement devices (not shown in FIG. 1) are brought into periodic (e.g., cyclic) contact with coating 11, whereby uneven portions of the coating such as spike 12 can be picked off and placed at other positions on the substrate, or whereby coating material can be placed in uneven portions of the coating such as depression 14. The placement periods of the pick-and-place devices are chosen so that their actions do not reinforce coating defects along the substrate. The pick-and-place devices can if desired be brought into contact with the coating only upon appearance of a defect. Alternatively, the pick-and-place devices can contact the coating whether or not a defect is present at the point of contact.

Figure 2:
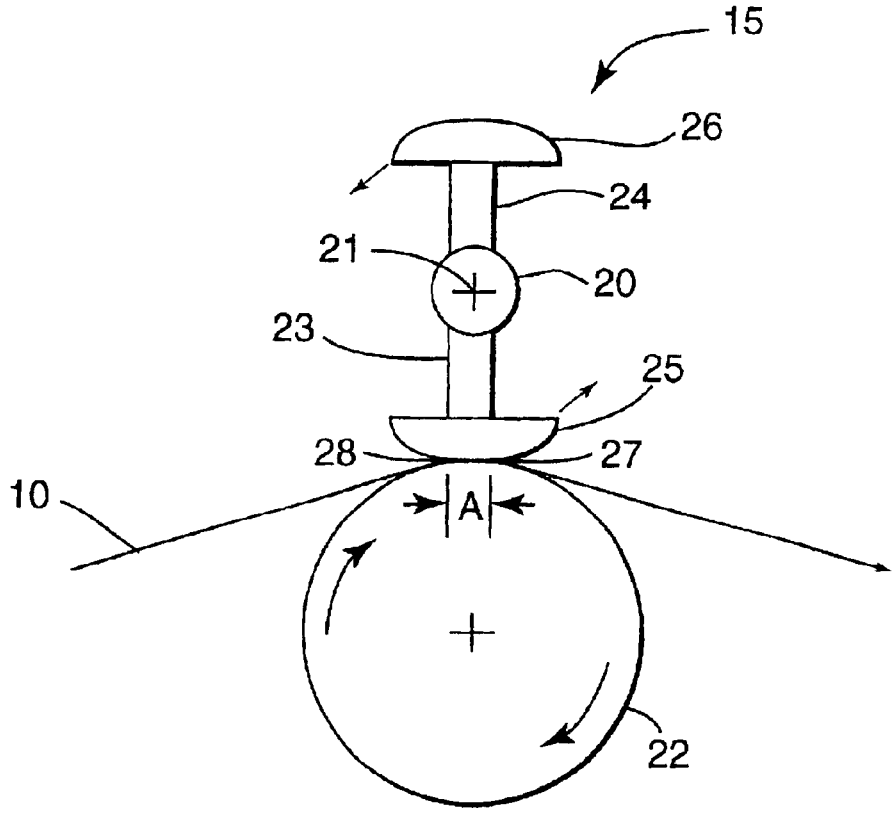
FIG. 2 is a schematic side view of a pick-and-place device.

A type of pick-and-place device 15 that can be used in the present invention to improve a coating on a moving web 10 is shown in FIG. 2. Device 15 has a hub 20 to permit device 15 to rotate about a central axis 21. The hub 20 and axis 21 extend across the coated width of the moving web 10, which is transported past hub 20 on roll 22.

Extending from hub 20 are two radial arms 23 and 24 to which are attached pick-and-place surfaces 25 and 26. Surfaces 25 and 26 are curved to produce a singular circular arc in space when surfaces 25 and 26 are rotated about axis 21. Because of their rotation and spatial relation to the web 10, pick-and-place surfaces 25 and 26 periodically contact web 10 opposite roll 22. Wet coating (not shown in FIG. 2) on web 10 and surfaces 25 and 26 fill a contact zone of width A on web 10 from starting point 28 to split point 27. At the split point, some liquid stays on both web 10 and surface 25 as the pick-and-place device 15 continues to rotate and web 10 translates over roll 22. Upon completing one revolution, surface 25 places the split liquid at a new longitudinal position on web 10.

Web 10 meanwhile will have translated a distance equal to the web speed multiplied by the time required for one rotation of the pick-and-place surface 25. In this manner, a portion of a liquid coating can be picked up from one web position and placed down on a web at another position and at another time. Both the pick-and-place surfaces 25 and 26 produce this action.

The period of a pick-and-place device can be expressed in terms of the time required for the device to pick up a portion of wet coating from one position along a substrate and then lay it down on another position, or by the distance along the substrate between two consecutive contacts by a surface portion of the device. For example, if the device shown in FIG. 2 is rotated at 60 rpm and the relative motion of the substrate with respect to the device remains constant, then the period is one second. As is explained in more detail below, if a plurality of such devices are employed then they preferably have two or more, and more preferably three or more different periods. Most preferably, pairs of such periods are not related as integer multiples of one another. The period of a pick-and-place device can be altered in many ways. For example, the period can be altered by changing the diameter of a rotating device; by changing the speed of a rotating or oscillating device; by repeatedly (e.g., continuously) translating the device along the length of the substrate (e.g., up web or down web) with respect to its initial spatial position as seen by a fixed observer; or by changing the translational speed of the substrate relative to the speed of rotation of a rotating device. The period does not need to be a smoothly varying function, and does not need to remain constant over time.

Many different mechanisms can produce a periodic contact with the liquid coated substrate, and many different shapes and configurations can be used to form the pick-and-place devices. For example, a reciprocating mechanism (e.g., one that moves up and down) can be used to cause the coating-wetted surfaces of a pick-and-place device to oscillate into and out of contact with the substrate. Preferably the pick-and-place devices rotate, as it is easy to impart a rotational motion to the devices and to support the devices using bearings or other suitable carriers that are relatively resistant to mechanical wear.

Although the pick-and-place device shown in FIG. 2 has a dumbbell shape and two noncontiguous contacting surfaces, the pick-and-place device can have other shapes, and need not have noncontiguous contacting surfaces. As is explained in more detail below, the pick-and-place devices can be a series of rolls that contact the substrate, or an endless belt whose wet side contacts a series of wet rolls and the substrate, or a series of belts whose wet sides contact the substrate, or combinations of these. These rotating pick-and-place devices preferably remain in continuous contact with the substrate.

The invention is especially useful for, but not limited to, coating moving webs. Rotating pick-and-place devices are preferred for such coating applications. The devices can translate (e.g., rotate) at the same peripheral speed as the moving web, or at a lesser or greater speed. If desired, the devices can rotate in a direction opposite to that of the moving web. Preferably, at least two of the rotating pick-and-place devices have the same direction of rotation and are not periodically related. More preferably, for applications involving the improvement of a coating on a web or other substrate having a direction of motion, the direction of rotation of at least two such pick-and-place devices is the same as the direction of substrate motion. Most preferably, such pick-and-place devices rotate in the same direction as and at substantially the same speed as the substrate. This can conveniently be accomplished by using corotating undriven rolls that bear against the substrate and are carried with the substrate in its motion.

When initially contacting the coating with a pick-and-place device like that shown in FIG. 2, a length of defective material is produced. At the start, the pick-and-place transfer surfaces 25 and 26 are dry. At the first contact, device 15 contacts web 10 at a first position on web 10 over a region A. At the split point 27, roughly half the liquid that entered region A at the starting point 28 will wet the transfer surface 25 or 26 with coating liquid and be removed from the web. This splitting creates a spot of low and defective coating caliper on web 10 even if the entering coating caliper was uniform and equal to the desired average caliper. When the transfer surface 25 or 26 re-contacts web 10 at a second position, a second coating liquid contact and separation occurs, and a second defective region is created. However, it will be less deficient in coating than the first defective region. Each successive contact produces smaller defective regions on the web with progressively smaller deviations from the average caliper until an equilibrium is reached.

Thus the initial contacting produces periodic variations in caliper for a length of time. This represents a repeating defect, and by itself, would be undesirable.

There is no guarantee that the liquid split ratio between the web and the surface will remain always at a constant value. Many factors can influence the split ratio, but these factors tend to be unpredictable. If the split ratio changes abruptly, a periodic down web caliper variation will result even if the pick-and-place device has been running for a long time. If foreign material lodges on a transfer surface of the pick-and-place device, the device may create a periodic down web defect at each contact. Thus use of only a single pick-and-place device can potentially create large lengths of scrap material.

The invention employs two or more, preferably three or more, and more preferably five or more or even eight or more pick-and-place devices in order to achieve good coating uniformity. When coating a moving web, these devices can be arranged down web from a coating station in an array that will be referred to as an "improvement station." After the coating liquid on the pick-and-place transfer surfaces has built to an equilibrium value, a random high or low coating caliper spike may pass through the station. When this happens, and if the defect is contacted, then the periodic contacting of the web by a single pick-and-place device, or by an array of several pick-and-place devices having the same contact period, will repropagate a periodic down web defect in the caliper. Again scrap will be generated and those skilled in coating would avoid such an apparatus. It is much better to have just one defect in a coated web rather than a length of web containing multiple images of the original defect.

We have discovered that more than one pick-and-place device can produce improved coating uniformity instead of extended lengths of defective coating. A single device, or a train of devices having identical or reinforcing periods of contact, can be very detrimental. However, we have found that a random initial defect entering the station or any defect generated by the first contacting can be diminished by using an improvement station comprising more than two pick and place devices whose periods of contact are selected to reduce rather than repropagate the defect. We have found that such an improvement station can diminish input defects to such an extent that the defects are no longer objectionable. By using the methods and devices of the invention, a new down web coating profile can be created at the exit from the improvement station. That is, by using multiple pick-and-place devices we can modify the multiple defect images that are propagated and repropagated by the first device with additional multiple defect images that are propagated and repropagated from the second and any subsequent devices. We can do this in a constructively and destructively additive manner so that the net result is near uniform caliper or a controlled caliper variation. We in effect create multiple waveforms that are added together in a manner so that the constructive and destructive addition of each waveform combines to produce a desired degree of uniformity. Viewed somewhat differently, when a coating upset passes through the improvement station a portion of the coating from the high spots is in effect picked off and placed back down in the low spots.

Figure 3:
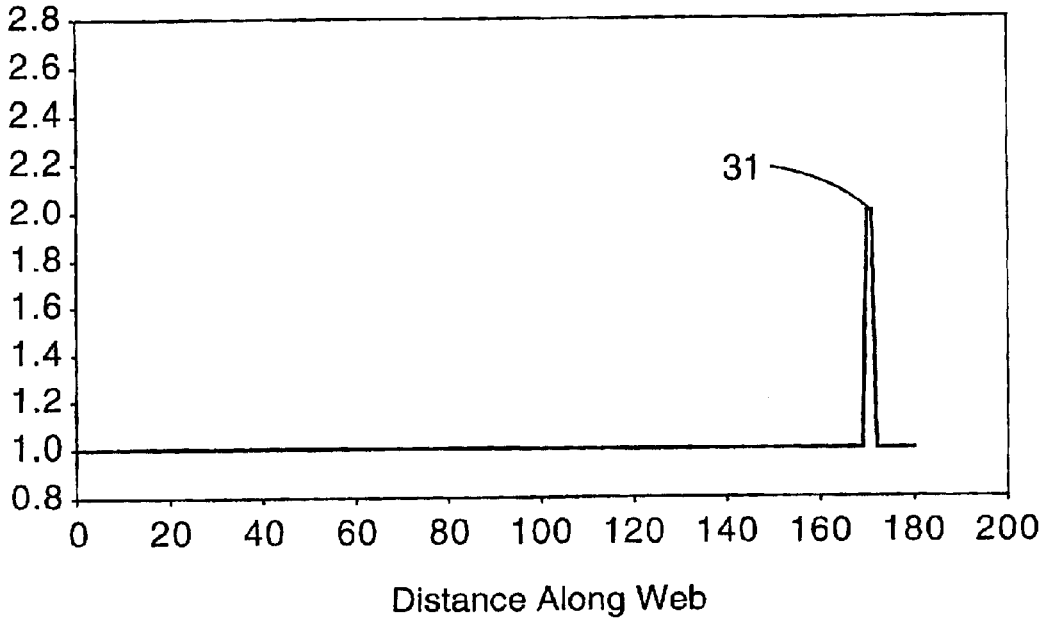
FIG. 3 is a graph of coating caliper vs. web distance for a single large caliper spike on a web.

Mathematical modeling of our new improvement process is helpful in gaining insight and understanding. The modeling is based on fluid dynamics, and provides good agreement to observable results. FIG. 3 shows a graph of liquid coating caliper vs. lengthwise (machine direction) distance along a web for a solitary random spike input 31 located at a first position on the web approaching a periodic contacting pick-and-place transfer device (not shown in FIG. 3). FIG. 4 through FIG. 10 show mathematical model results illustrating the liquid coating caliper along the web when spike input 31 encounters one or more periodic pick-and-place contacting devices.

Figure 4:
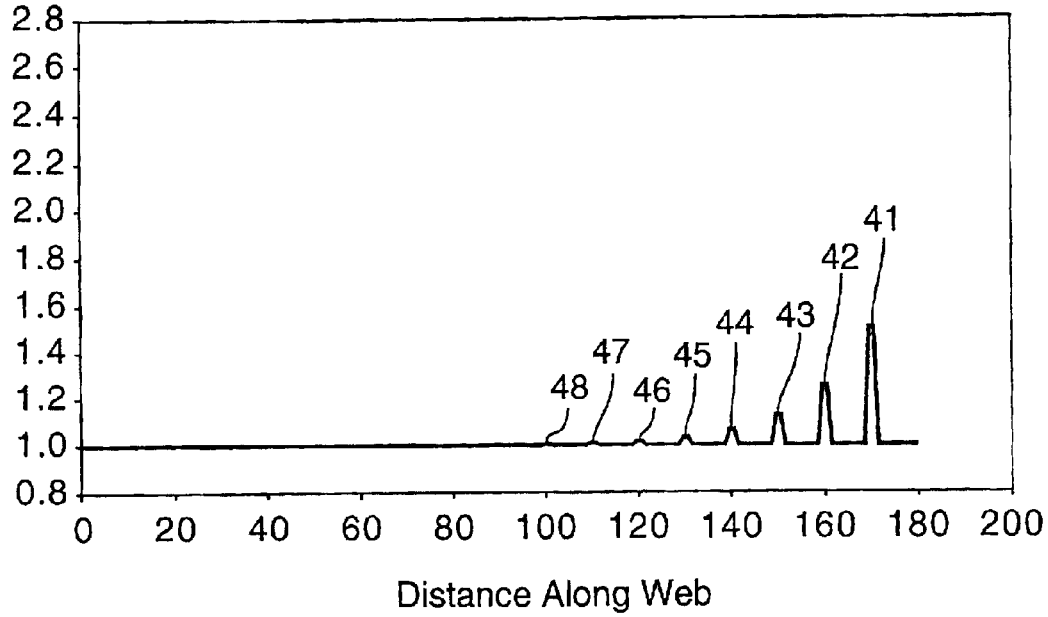
FIG. 4 is a graph of coating caliper vs. web distance when the spike of FIG. 3 encounters a single periodic pick-and-place device having a period of 10.

FIG. 4 shows the amplitude of the reduced spike 41 that remains on the web at the first position and the repropagated spikes 42, 43, 44, 45, 46, 47 and 48 that are placed on the web at second and subsequent positions when spike input 31 encounters a single periodic pick-and-place contacting device. The peak of the initial input spike 31 is one length unit long and two caliper units high. The contacting device period is equivalent to ten length units. The images of the input defect are repeated periodically in 10 unit increments over a length longer than sixty length units. Thus, the length of defectively coated or "reject" web is greatly increased compared to the length of the input defect. The exact defective length, of course, depends on the acceptable coating caliper variability for the desired end use.

Figure 5:
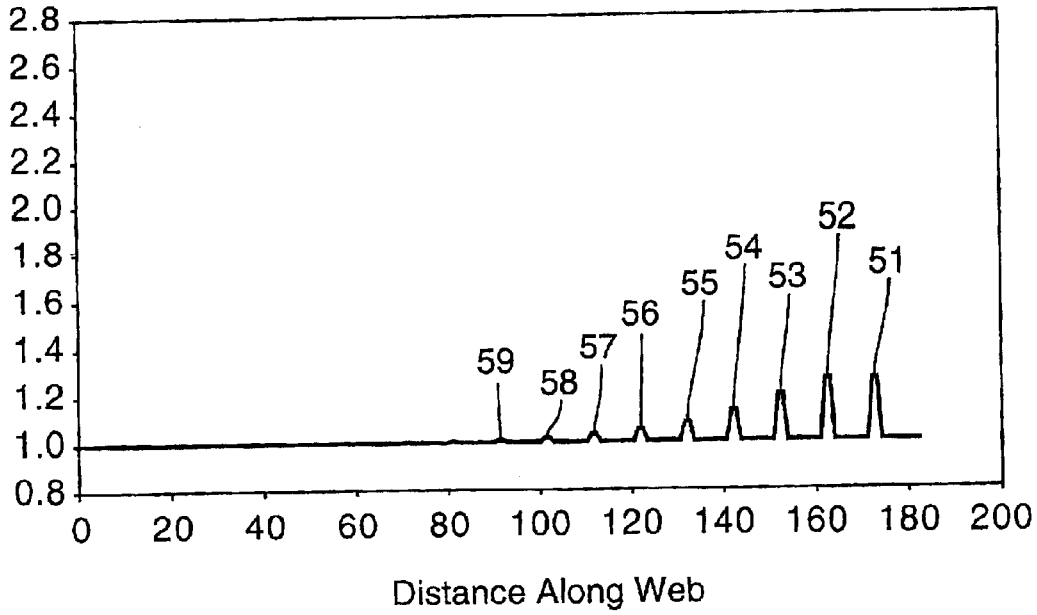
FIG. 5 is a graph of coating caliper vs. web distance when the spike of FIG. 3 encounters two periodic pick-and-place devices having a period of 10.

FIG. 5 shows the amplitude of the reduced spike 51 that remains on the web at the first position and some of the repropagated spikes 52, 53, 54, 55, 56, 57, 58 and 59 that are placed on the web at second and subsequent positions when spike input 31 encounters two periodic, sequential, synchronized pick-and-place transfer devices each having a period of 10 length units. Compared to the use of a single periodic pick-and-place device, a lower amplitude spike image occurs over a longer length of the web.

Figure 6:
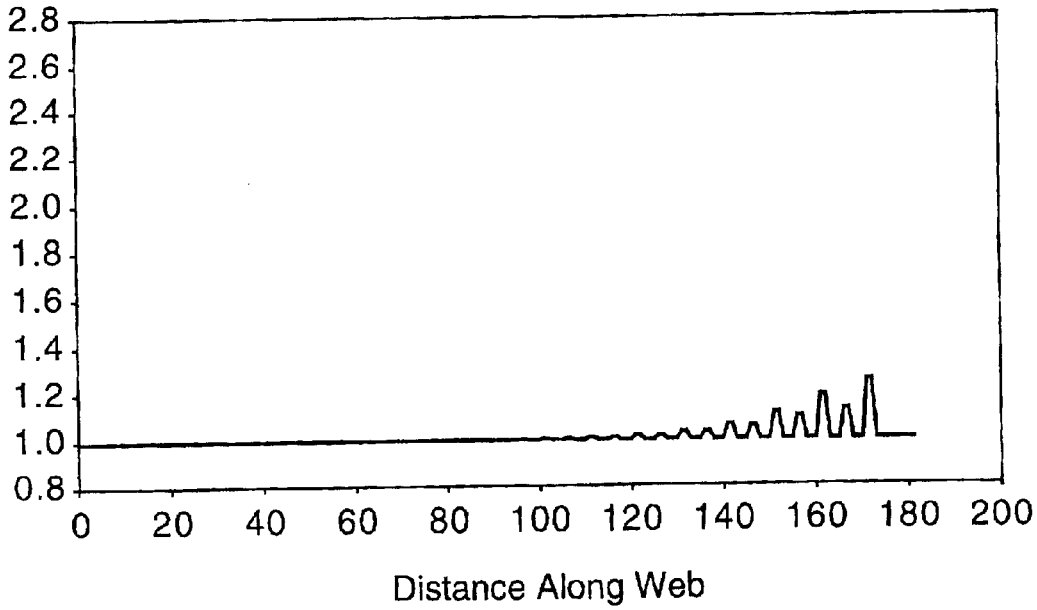
FIG. 6 is a graph of coating caliper vs. web distance when the spike of FIG. 3 encounters two periodic pick-and-place devices having periods of 10 and 5, respectively.

FIG. 6 shows the coating that results when two periodic, sequential, synchronized contacting devices having periods of 10 and then 5 are used. These devices have periodically related contacting periods. Their pick-and-place action will deposit coating at periodically related positions along the web. Compared to FIG. 5, the spike image amplitude is not greatly reduced but a somewhat shorter length of defective coated web is produced.

Figure 7:
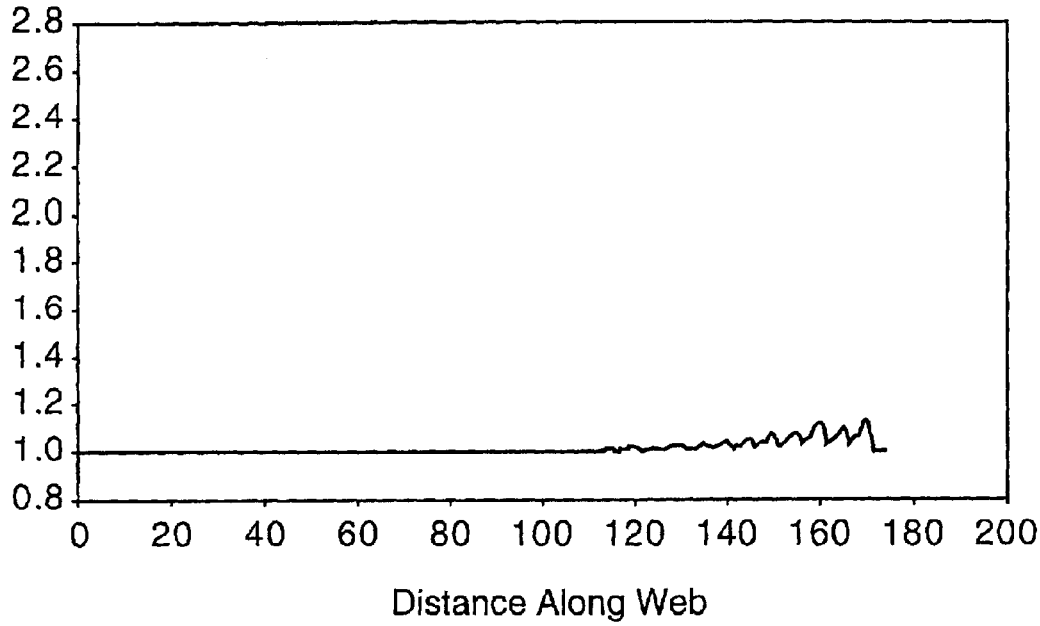
FIG. 7 is a graph of coating caliper vs. web distance when the spike of FIG. 3 encounters three periodic pick-and-place devices having periods of 10, 5 and 2, respectively.

FIG. 7 shows the coating that results when a method and device of the invention are employed. In this embodiment, three periodic pick-and-place devices having different periods of 10, 5 and 2 are used. The device with a period of 10 and the device with a period of 5 are periodically related. The device with a period of 10 and the device with a period of 2 are also periodically related. However, the device with a period of 5 and the device with a period of 2 are not periodically related (because 5 is not an integer multiple of 2), and thus this train of devices includes first and second periodic pick-and-place devices that can contact the coating at a first position on the web and then re-contact the coating at second and third positions on the web that are not periodically related to one another with respect to their distance from the first position. Compared to the devices whose actions are shown in FIG. 4 through FIG. 6, much lower caliper deviations and much shorter lengths of defective coated web are produced.

Figure 8:
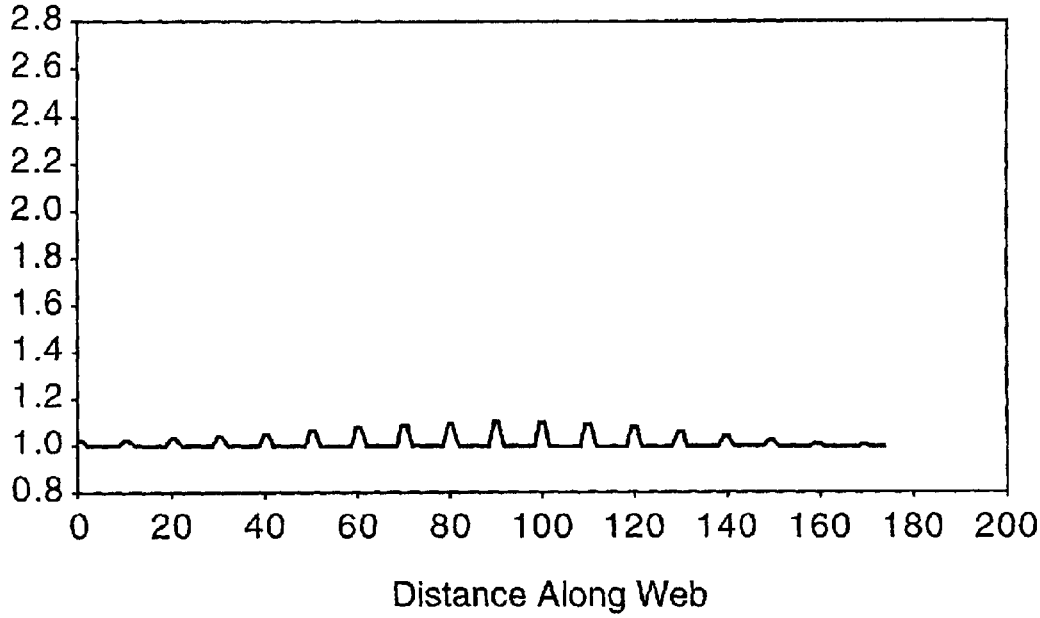
FIG. 8 is a graph of coating caliper vs. web distance when the spike of FIG. 3 encounters eight periodic pick-and-place devices having a period of 10.
Figure 9:
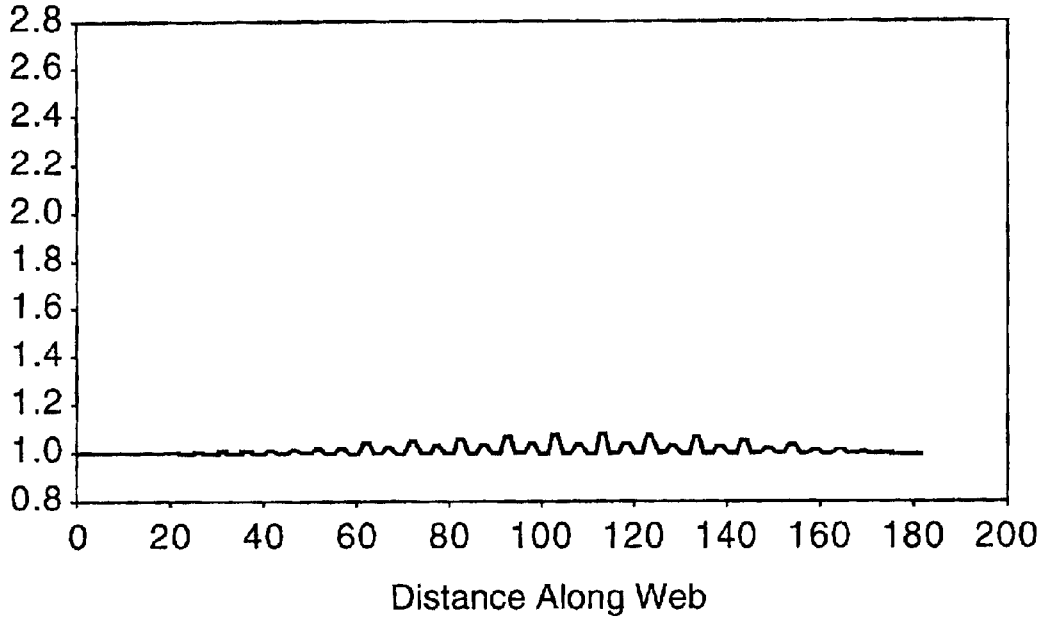
FIG. 9 is a graph of coating caliper vs. web distance when the spike of FIG. 3 encounters one periodic pick-and-place device having a period of 10 followed by seven devices having periods of 5.
Figure 10:
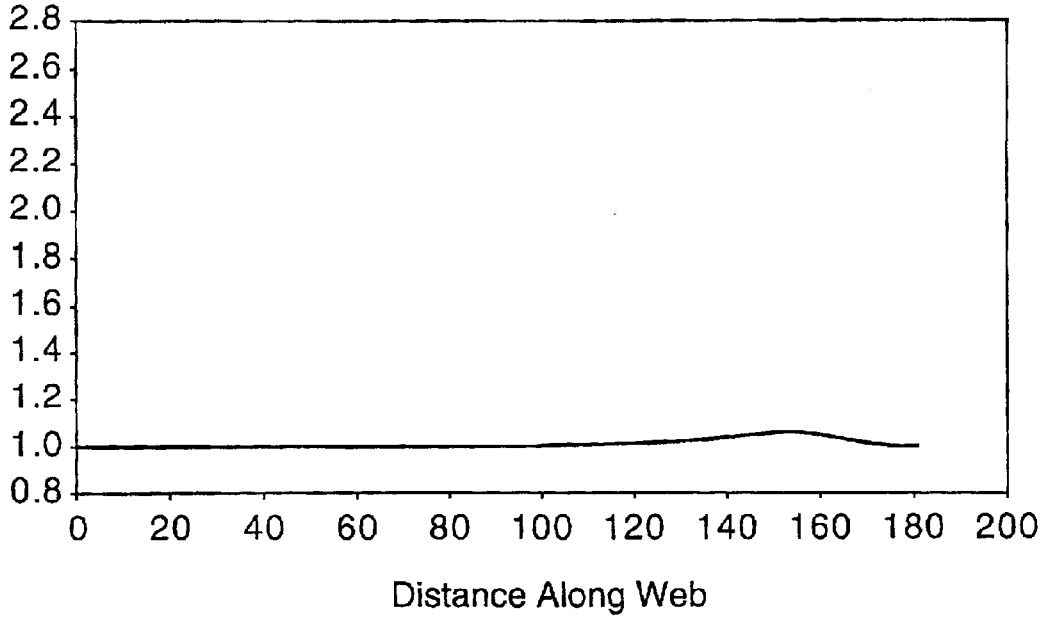
FIG. 10 is a graph of coating caliper vs. web distance when the spike of FIG. 3 encounters one periodic pick-and-place device having a period of 10 followed by one device having a period of 5 and six devices having a period of 2.

FIG. 8, FIG. 9 and FIG. 10 show the results for trains of eight contacting devices having different sets of periods. The best result occurs when three different periods are used (FIG. 10, where the first device has a period of 10, the second device has a period of 5, and the third through eighth devices have a period of 2), and the worst occurs when all the periods are equal (FIG. 8, where all eight devices have a period of 10). An intermediate result is shown in FIG. 9, where the first device has a period of 10 and the second through eighth devices have a period of 5). As can be seen by comparing FIG. 8 and FIG. 5, using eight instead of two devices with equal periods diminishes the amplitudes of the spike images.

Similar coating improvement results are obtained when the random defect is a depression (e.g., an uncoated void) or bar mark rather than a spike.

The random spike and depression defects discussed above are one general class of defect that may be presented to the improvement station. The second important class of defect is a periodically repeating defect. Of course, in manufacturing coating facilities it is common to have both classes occurring simultaneously. If a periodic train of high or low coating spikes or depressions is present on a continuously running web, the coating equipment operators usually seek the cause of the defect and try to eliminate it. A single periodic pick-and-place device as illustrated in FIG. 2 may not help and may even further deteriorate the quality of the coating. However, intermittent periodic contacting of the coating by devices similar in function to that exemplified in FIG. 2 produces an improvement in coating uniformity when more than two devices are employed and when the device periods are properly chosen. Improvements are found for both random and continuous, periodic variations and combinations of the two. In general, better results will be obtained when an effort is made to adjust the relative timing of the contacts by individual devices, so that undesirable additive effects can be avoided. The use of rolls running in continuous contact with the coating avoids this complication and provides a somewhat simpler and preferred solution. Because every increment of a roll surface running on a web periodically contacts the web, a roll surface can be considered to be a series of connected intermittent periodic contacting surfaces. Similarly, a rotating endless belt can perform the same function as a roll. If desired, a belt in the form of a Mobius strip can be employed. Those skilled in the art of coating will recognize that other devices such as elliptical rolls or brushes can be adapted to serve as periodic pick-and-place devices in our invention. Exact periodicity of the devices is not required. Mere repeating contact will suffice.

Figure 11:
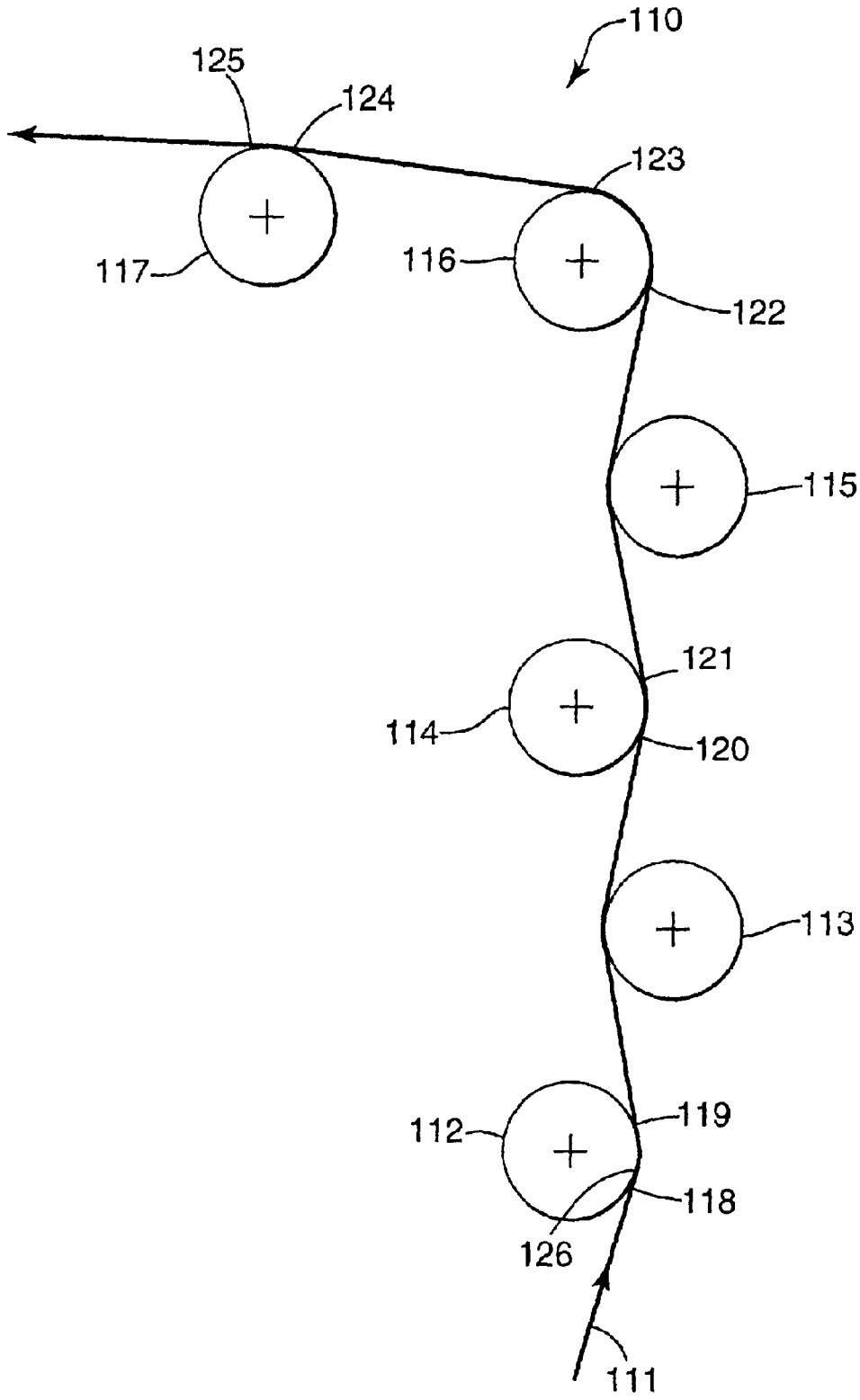
FIG. 11 is a schematic side view of a pick-and-place device that employs a set of equal diameter non-equally driven contacting rolls.

FIG. 11 shows a uniformity improvement station 110 that uses a train of pick-and-place roll contactors. Liquid-coated web 111 is coated on its upper surface prior to entering improvement station 110 using a coating device not shown in FIG. 11. Liquid coating caliper on web 111 spatially varies in the down-web direction at any instant in time as it approaches pick-and-place contactor roll 112. To a fixed observer, the coating caliper would exhibit time variations. This variation may contain transient, random, periodic, and transient periodic components in the down web direction. Web 111 is directed along a path through station 110 and into contact with the pick-and-place contactor rolls 112, 114, 116 and 117 by idler rolls 113 and 115. The path is chosen so that the wet coated side of the web comes into physical contact with the pick-and-place rolls. Pick-and-place rolls 112, 114, 116 and 117 (which as shown in FIG. 11 all have the same diameter) are driven so that they rotate with web 111 but at speeds that vary with respect to one another. For example, there can be a speed differential between the substrate and at least one roll, or speed differentials between the substrate and two or more rolls, e.g., sinusoidal speed differentials, speed differentials having opposite signs for a portion of time, or speed differentials that are periodic and out of phase (e.g., by 180 degrees) with one another. The roll periods or speeds are adjusted to provide an improvement in coating uniformity on web 111. At least two and preferably more than two of the pick-and-place rolls 112, 114, 116 and 117 do not have the same speed and are not integer multiples of one another.

Referring for the moment to pick-and place roll 112, the liquid coating splits at lift off point 119. A portion of the coating travels onward with the web and the remainder travels with roll 112 as it rotates away from lift off point 119. Variations in coating caliper just prior to lift off point 119 are mirrored in both the liquid caliper on web 111 and the liquid caliper on the surface of roll 112 as web 111 and roll 112 leave lift off point 119. After the coating on web 111 first contacts roll 112 and roll 112 has made one revolution, the liquid on roll 112 and incoming liquid on web 111 meet at the initial contact point 118, thereby forming a liquid filled nip region 126 between points 118 and 119. Region 126 is without air entrainment. To a fixed observer, the flow rate of the liquid entering this nip contact region 126 is the sum of the liquid entering on the web 111 and the liquid entering on the roll 112. The net action of roll 112 is to pick material from web 111 at one position and place a portion of the material down again at another position.

In a similar fashion, the liquid coating splits at lift off points 121, 123 and 125, and a portion of the coating re-contacts web 111 at contact points 120, 122 and 124 and is reapplied thereto.

As with the trains of intermittent pick-and-place contacting devices discussed above, random or periodic variations in the liquid coating caliper on the incoming web will be reduced in severity and desirably the variations will be substantially eliminated by the pick-and-place action of the periodic contacting rolls. Also, as with the devices discussed above, a single roll running in contact with the liquid coating on the web, or a train of periodically related rolls, will generally tend to propagate defects and produce large amounts of costly scrap.

Figure 12:
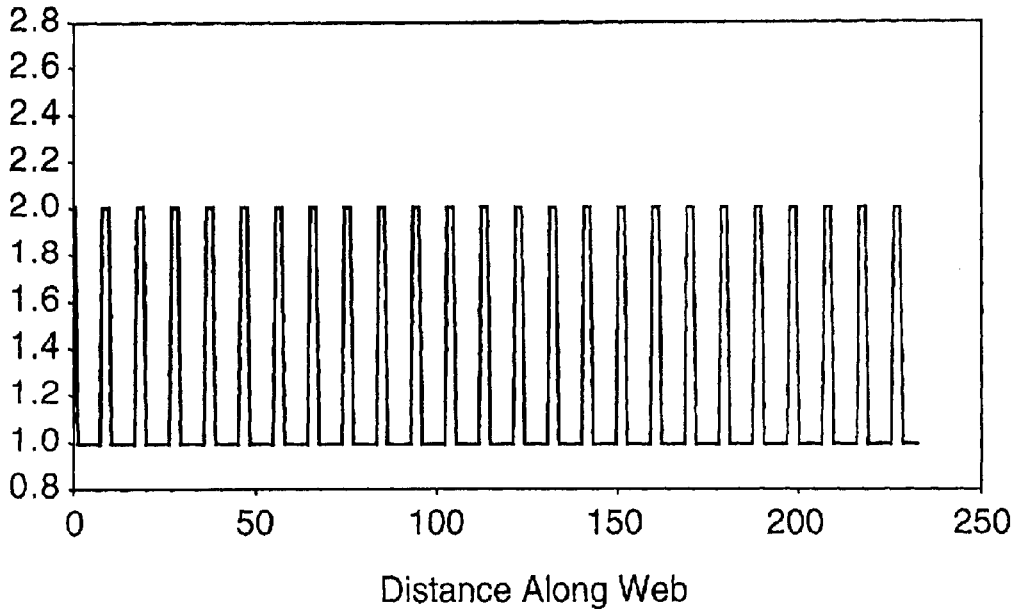
FIG. 12 is a graph of coating caliper vs. web distance for a repeating spike defect having a period of 10.
Figure 13:
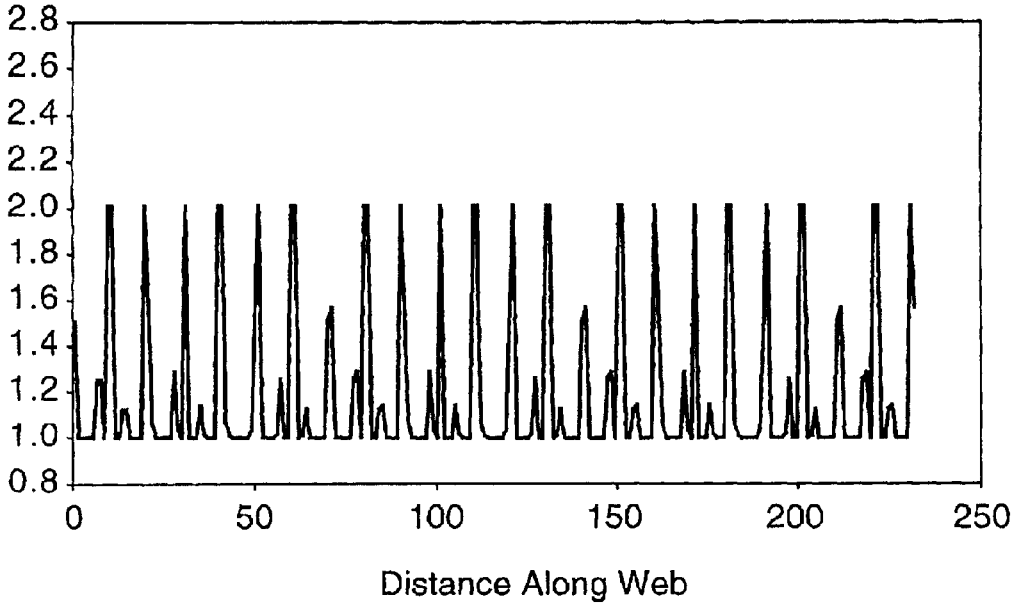
FIG. 13 is a graph of coating caliper vs. web distance when the spikes of FIG. 11 encounter a periodic pick-and-place device having a period of 7.

FIG. 12 shows a graph of liquid coating caliper vs. distance along a web for a succession of equal amplitude repeating spike inputs approaching a periodic contacting pick-and-place transfer device. If a pick-and-place device periodically and synchronously contacts this repeating defect and if the period equals the defect period, there is no change produced by the device after the initial start-up. This is also true if the period of the device is some integer multiple of the defect period. Simulation of the contacting process shows that a single device will produce more defective spikes if the period is shorter than the input defect period. FIG. 13 shows this result when a repeating defect having a period of 10 encounters a periodic pick-and-place roll device having a period of 7.

Figure 14:
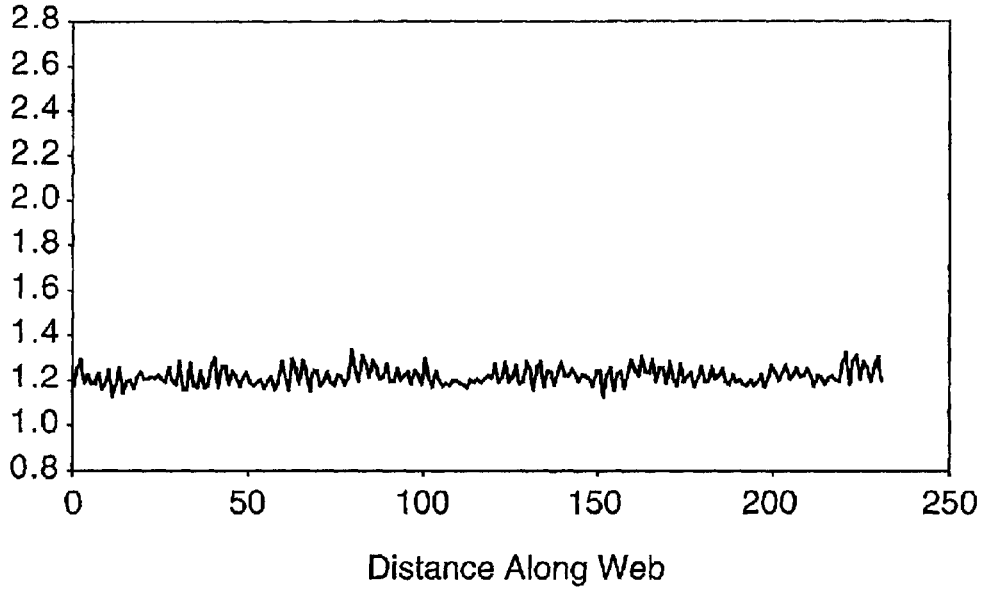
FIG. 14 is a graph of coating caliper vs. web distance when the spikes of FIG. 11 encounter a train of seven periodic pick-and-place devices having periods of 7, 5, 4, 8, 3, 3 and 3, respectively.
Figure 15:
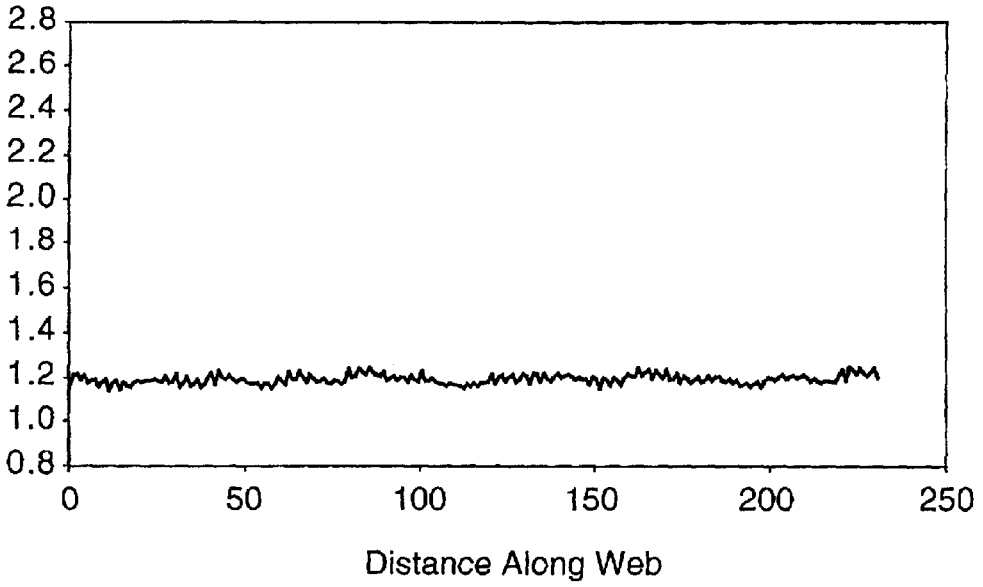
FIG. 15 is a graph of coating caliper vs. web distance when the spikes of FIG. 11 encounter a train of eight periodic pick-and-place devices having periods of 7, 5, 4, 8, 3, 3, 3 and 2, respectively.

By using multiple devices and properly selecting their periods of contact, we can substantially improve the quality of even a grossly non-uniform input coating. FIG. 14 and FIG. 15 show the simulation results when coatings having the defect pattern shown in FIG. 12 were exposed to trains of seven or eight periodic pick-and-place roll devices having periods that were not all related to one another. In FIG. 14 the devices had periods of 7, 5, 4, 8, 3, 3 and 3. In FIG. 15 the devices had periods of 7, 5, 4, 8, 3, 3, 3 and 2. In both cases, the amplitude of the highest spikes diminished by greater than 75%. Thus even though the number of spikes increased, overall a significant improvement in coating caliper uniformity was obtained.

Factors such as drying, curing, gellation, crystallization or a phase change occurring with the passage of time can impose limitations on the number of rolls employed. If the coating liquid contains a volatile component, the time necessary to translate through many rolls may allow drying to proceed to the extent that the liquid may solidify. Drying is actually accelerated by our invention, providing certain advantages discussed in more detail below. In any event, if a coating phase change occurs on the rolls for any reason during operation of the improvement station, this will usually lead to disruptions and patterns in the coating on the web. Therefore, in general we prefer to produce the desired degree of coating uniformity using as few rolls as possible.

By using multiple pick-and-place rolls we can simultaneously reduce the amplitude of and merge successive spikes or depressions together to form a continuously slightly varying but spike- and depression-free coating of good uniformity. As shown in FIG. 11, this can be accomplished by using roll devices of equal diameters driven at unequal speeds. Improvements in coating uniformity can also be obtained by varying the diameters of a train of roll devices. If the rolls are not independently driven, but instead rotated by the traction with the web, then the period of each roll is related to its diameter and its traction with the wet web. Selection of differently sized rolls can require extra time for initial setup, but because the rolls are undriven and can rotate with the web, the overall cost of the improvement station will be substantially reduced.

A recommended procedure for determining a set of pick-and-place roll diameters and therefore their periods is as follows. First, measure the down web coating weight continuously and determine the period, P, of the input of an undesired periodic defect to the improvement station. Then select a series of pick-and-place roll diameters with periods ranging from less than to larger than the input period avoiding integer multiples or divisors of that period. From this group, determine which roll gives the best improvement in uniformity by itself alone. From the remaining group, select a second roll that gives the best improvement in uniformity when used with the first selected roll. After the first two rolls are determined, continue adding additional pick-and-place rolls one by one on the basis of which of those available gives the best improvement. The best set of rolls is dependent upon the uniformity criterion used and the initial unimproved down web variation present. Our preferred starting set of rolls include those with periods, Q, ranging from Q=0.26 to 1.97 times the period of the input defect, in increments of 0.03. Exceptions are Q=0.5, 0.8, 1.1, 1.25, 1.4, and 1.7. Periods of (Q+nP) and (Q+kP) where n is an integer and k=1/n are also suggested.

Figure 16:
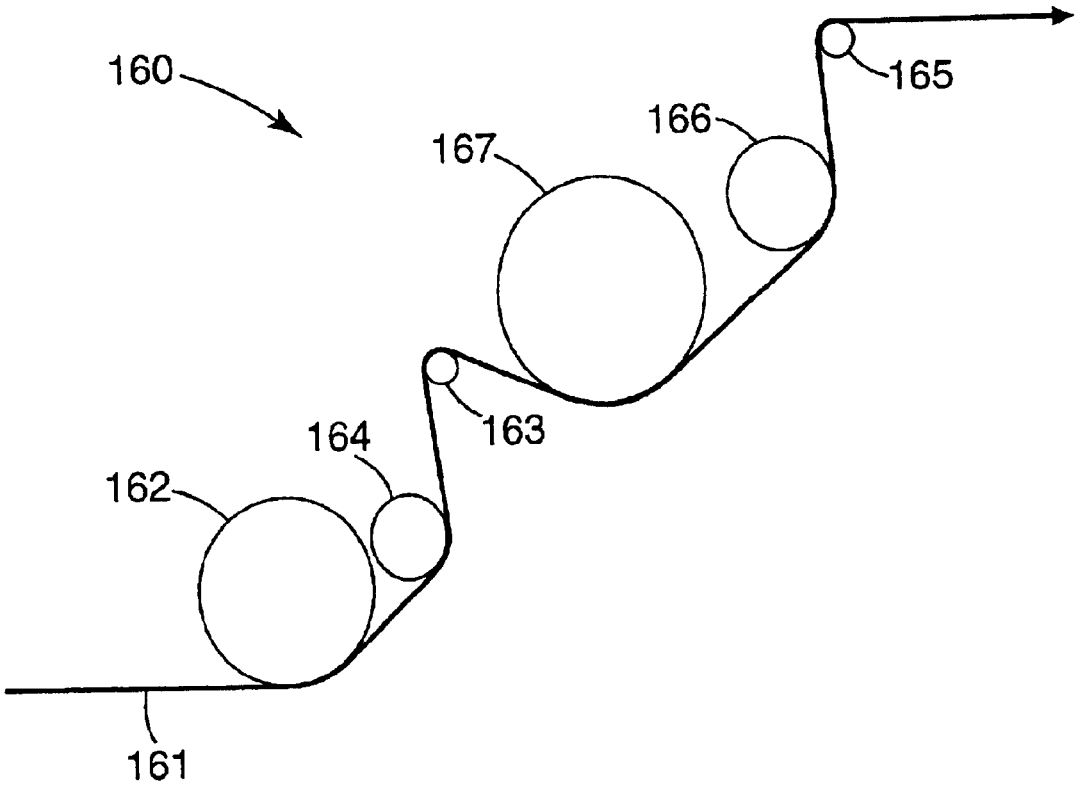
FIG. 16 is a schematic side view of a pick-and-place device that employs a set of unequal diameter undriven contacting rolls.

FIG. 16 shows a uniformity improvement station 160 that uses a train of pick-and-place roll contactors having different diameters. Liquid-coated web 161 is coated on its upper surface prior to entering improvement station 160 using a coating device not shown in FIG. 16. Web 161 is directed along a path through station 160 and into contact with the pick-and-place contactor rolls 162, 164, 166 and 167 by idler rolls 163 and 165.

Figure 17:
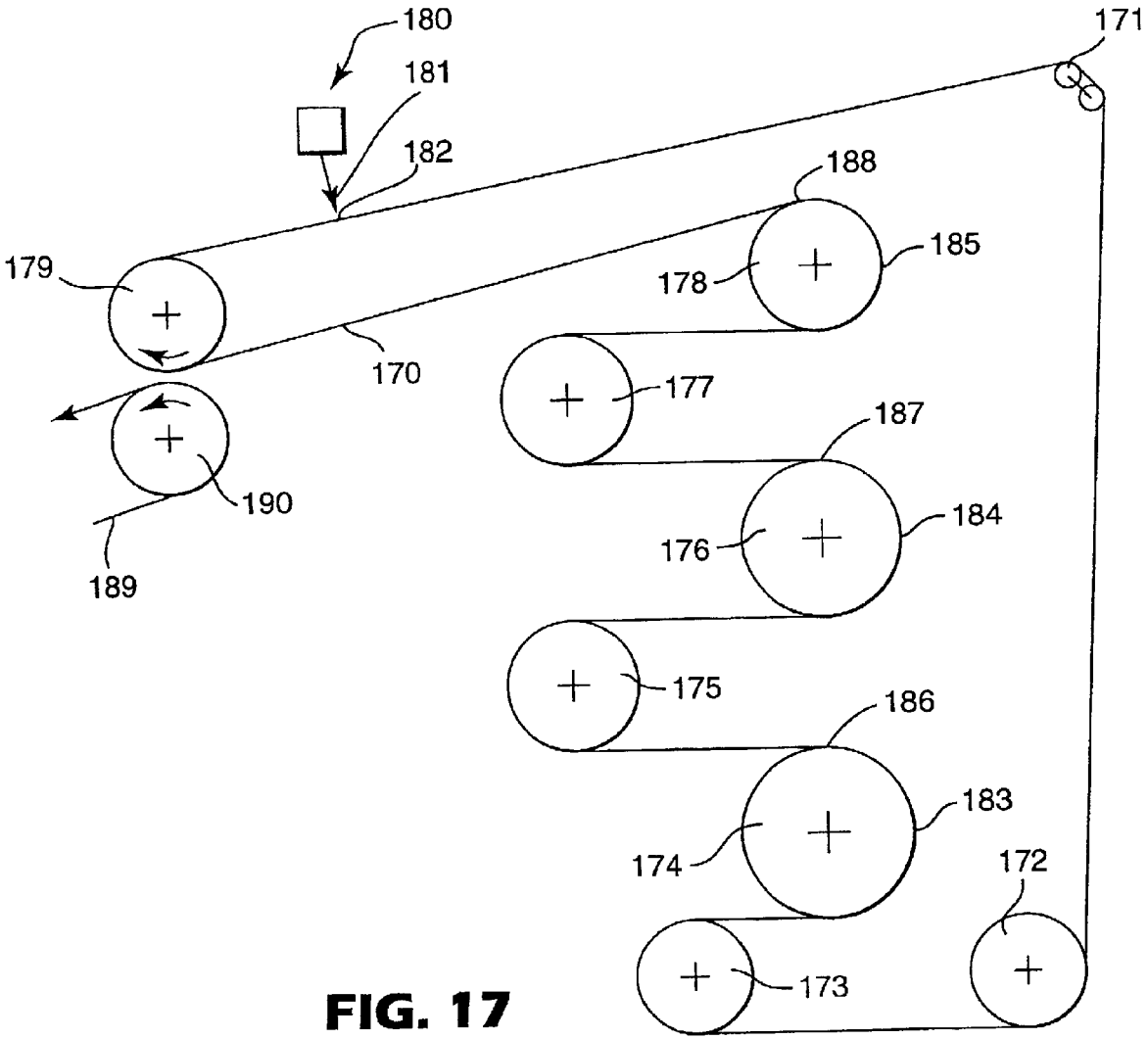
FIG. 17 is a schematic side view of a pick-and-place device that employs a transfer belt.

FIG. 17 shows a coating apparatus of the invention employing a belt 170. Belt 170 circulates on steering unit 171; idlers 172, 173, 175 and 177; pick-and-place rolls 174, 176 and 178; and back-up roll 179. Intermittent coating station 180 oscillates a hypodermic needle 181 back and forth across belt 170 at stripe coating region 182. The applied stripe forms a zig-zag pattern upset across belt 170, thereby creating an intermittent coating defect downstream from station 180. Following startup of the equipment and a few rotations of belt 170, belt 170 will become wet across its entire surface with an uneven coating. If the speed of the belt and the traversing period and fluid delivery rate of the needle are held constant, then to a fixed observer viewing a point atop the belt just downstream from region 182, the coating caliper on the belt will range from a minimum to a maximum value and back. If the speed of the belt or the traversing period or delivery rate of the needle are not held constant, then the observed coating could contain additional transient, random, periodic, or transient periodic components in the belt length direction. In either case, the coating will be very uneven. The advantages of such a stripe coating belt station are discussed in more detail below.

Belt 170 circulates past undriven corotating pick-and-place rolls 174, 176 and 178 having respective relative diameters of, for example, 1.36, 1.26 and 1, thereby bringing the lengthwise variable coating into contact with the surfaces of pick-and-place rolls 174, 176 and 178 at the liquid-filled nip regions 183, 184 and 185. Following startup of the equipment and a few rotations of belt 170, the coating liquid wets the surfaces of the pick-and-place rolls 174, 176 and 178. As with the device shown in FIG. 11, the liquid coating splits at the trailing end (the lift-off points) 186, 187 and 188 of the liquid-filled nip regions 183, 184 and 185. A portion of the coating remains on the pick-and-place rolls 174, 176 and 178 as they rotate away from the lift-off points 186, 187 and 188. The remainder of the coating travels onward with belt 170. Variations in the coating caliper just prior to the lift-off points 186, 187 and 188 will be mirrored in both the liquid caliper variation on belt 170 and on the surfaces of the pick-and-place rolls 174, 176 and 178 as they leave lift-off points 186, 187 and 188. Following further movement of belt 170, the liquid on the pick-and-place rolls 174, 176 and 178 will be redeposited on belt 170 in new positions along belt 170.

The embodiment of FIG. 17 as so far described can be used to produce a uniform coating on the belt itself; or to improve coating uniformity on a previously coated belt. The wet belt 170 can also be used to transfer the coating to a target web substrate 189. For example, target web 189 can be driven by powered roll 190 and brought into contact with belt 170 as belt 170 circulates around back-up roll 179. Rolls 179 and 190 are nipped together, thus forcing belt 170 into face-to-face contact with web 189. Upon separating from belt 170, some portion of the liquid coating will be transferred to the surface of web 189. When using the device to continuously coat the target web 189, liquid is preferably constantly added to belt 170 at region 182 on each revolution of the belt, and continuously removed at the nip point between rolls 179 and 190. Because following startup, belt 170 will already be coated with liquid, there will not be a three phase (air, coating liquid and belt) wetting line at stripe coating region 182. This makes application of the coating liquid much easier than is the case for direct coating of a dry web. Since only about one half the liquid is transferred at the 179, 190 roll nip, the percentage of caliper non-uniformity downstream from region 182 will generally be much smaller (e.g., by as much as half an order of magnitude) than when stripe coaxing a dry web without a transfer belt and passing the thus-coated web through an improvement station of the invention having the same number of rolls.

As with direct web coating, when the amount of liquid necessary for the desired average coating caliper is applied intermittently to wet belt 170, the period and number of pick-and-place rolls preferably is chosen to accommodate the largest spacing between any two adjacent, down web deposits of coating. As with direct web coating, a significant advantage of our method is that it is often easy to produce heavy cross web stripes or zones of coating on a belt but difficult to produce thin, uniform and continuous coatings. Another important attribute of our method is that it has pre-metering characteristics, in that coating caliper can be controlled by adjusting the amount of liquid applied to the belt.

Although a speed differential can be employed between belt 170 and any of the other rolls shown in FIG. 17, or between belt 170 and web 189, we prefer that no speed differential be employed between belt 170 and pick-and-place rolls 174, 176 and 178, or between belt 170 and web 189. This simplifies the mechanical construction of the device.

Figure 18:
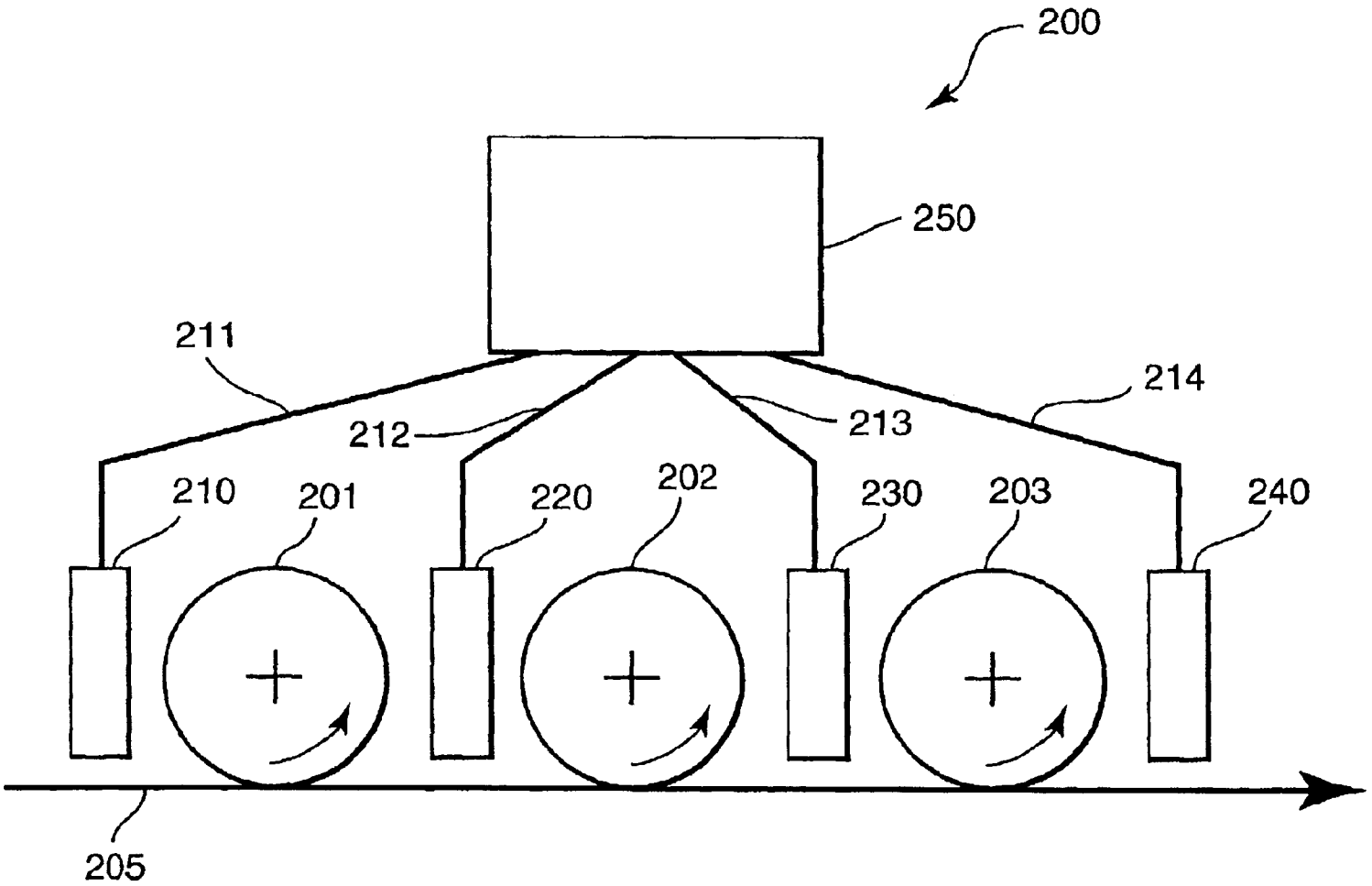
FIG. 18 is a schematic side view of a control system for a pick-and-place improvement station.

FIG. 18 shows a caliper monitoring and control system for use in an improvement station 200 of our invention. This system permits monitoring of the coating caliper variation and adjustment in the period of one or more of the pick-and-place devices in the improvement station, thereby permitting improvement or other desired alteration of the coating uniformity. This will be especially useful if the period of the incoming deviation changes. Referring to FIG. 18, pick-and-place transfer rolls 201, 202 and 203 are attached to powered driving systems (not shown in FIG. 18) that can independently control the rates of rotation of the rolls in response to a signal or signals from controller 250. The rates of rotation need not all match one another and need not match the speed of the substrate 205. Sensors 210, 220, 230 and 240 can sense one or more properties (e.g., caliper) of substrate 205 or the coating thereon, and can be placed before and after each pick-and-place roll 201, 202 and 203. Sensors 210, 220, 230 and 240 are connected to controller 250 via signal lines 211, 212, 213 and 214. Controller 250 processes signals from one or more of sensors 210, 220, 230 and 240, applies the desired logic and control functions, and produces drive control signals that are sent to the motor drives for one or more of pick-and-place transfer rolls 201, 202 and 203 to produce adjustments in the speeds of one or more of the rolls. In one embodiment, the automatic controller 250 can be a microprocessor that is programmed to compute the standard deviation of the coating caliper at the output side of roll 201 and to implement a control function to seek the minimum standard deviation of the improved coating caliper. Depending on whether or not rolls 201, 202 and 203 are controlled individually or together, appropriate single or multi-variable closed-loop control algorithms from sensors positioned after the remaining pick-and-place rolls can also be employed to control coating uniformity. Sensors 210, 220, 230 and 240 can employ a variety of sensing systems, such as optical density gauges, beta gauges, capacitance gages, fluorescence gauges or absorbance gauges.

As mentioned in connection with FIG. 17, a stripe coater can be used to apply an uneven coating to a substrate, followed by passage of the uneven coating through an improvement station of our invention. This represents another aspect of our invention, in that when the input coating liquid caliper is uneven (e.g., periodically varying, discontinuous or intermittent), a series of properly chosen pick-and-place rolls will spread the uneven coating into a continuous down-web coating of good uniformity. Many methods can be used to produce an uneven coating on a web. Ordinarily such coatings are regarded as undesirable and are avoided. We prefer them. A significant advantage of our method is that it is easy to produce an uneven and ordinarily defective coating but difficult to produce thin, uniform continuous coatings in one step. Also, it is easier to meter an uneven coating than a thin, uniform coating. Thus our invention teaches the formation of a metered, uniform coating from an uneven or discontinuous coating. Combining a deliberate uneven coating step with a uniformity improvement step enables production of continuous coatings, and especially production of thin, uniform continuous coatings, at high precision and with simple, low cost equipment.

Most known coating methods can be operated in non-preferred operating modes to apply uneven down web coatings. For example, a gravure coater can be operated so that it deliberately produces a coating with gravure marks, bar marks, or chatter. All such methods for producing an uneven coating fall within the scope of this invention. In a particularly preferred embodiment, we apply a discontinuous set of cross web coating stripes to a web. The cross web coating stripes need not be perpendicular to the web edge. The stripes can be diagonal across the web. Periodic initial placement of liquid onto the web is preferred, but it is not necessary. The stripes are easily applied. For example, a simple hose or number of hoses periodically swept back and forth across the web width can be used to apply a metered amount of coating discontinuously. This represents a very low cost and easily constructed coating device. It has a premetering capability, in that the overall final coating caliper can be calculated in advance and varied as needed by metering the stripe period or stripe width or the instantaneous flow rate to the stripe applicator.

Coating liquids can be applied in a variety of uneven patterns other than stripes, and by using methods that involve or do not involve contact between the applicator and the surface to which the coating is applied. For example, the above-described needle applicator can contact or not contact the surface to which the coating is applied. Also, a pattern of droplets can be sprayed onto the substrate using a suitable non-contacting spray head or other drop-producing device. If a fixed flow rate to a drop-producing device is maintained, the substrate translational speed is constant, and most of the drops deposit upon the substrate, then the average deposition of liquid will be nearly uniform. However since the liquid usually deposits itself in imperfectly spaced drops, there will be local variations in the coating caliper. If the drop deposition frequency is low or the drop size is low, the drops may not touch, thus leaving uncoated areas in between. Sometimes these sparsely placed drops will spontaneously spread and merge into a continuous coating, but this may take a long time or occur in a manner that produces a non-uniform coating. In any event we prefer to employ an improvement station of our invention (e.g., a set of multiple contacting rolls having selected periods) in order to improve the uniformity of the applied drops or other uneven coating. The improvement station can convert the drops to a continuous coating, or improve the uniformity of the coating, or shorten the time and machine length needed to accomplish drop spreading. The act of contacting the initial drops with rolls or other selected periodic pick-and-place devices, removing a portion of the drop liquid, then placing that removed portion back on the substrate in some other position increases the surface coverage on the substrate, reduces the distance between coated spots and increases the drop population density. The contacting action also creates pressure forces on the drop and substrate, thereby accelerating the rate of drop spreading. Contact in the area around and at a drop may produce a high liquid interface curvature at or near the spreading line and thereby enhance the rate of drop spreading. Thus the use of selected periodic pick-and-place devices makes possible rapid spreading of drops applied to a substrate and improves the uniformity of the final coatings.

If the spraying deposition rate is large enough to produce a continuous coating, the statistical nature of spraying will produce non-uniformities in the coating caliper. Here too, the use rolls or other selected periodic pick-and-place devices can improve coating uniformity.

Spraying can be accomplished using many different types of devices. Examples include point source nozzles such as airless, electrostatic, spinning disk and pneumatic spray nozzles. Line source atomization devices are also known and useful. The droplet size may range from very large (e.g., greater than 1 millimeter) to very small. The nozzle or nozzles can be oscillated back and forth across the substrate, e.g, in a manner similar to the above-described needle applicator.

This beneficial application of the periodic pick-and-place devices of our invention can be tested experimentally or simulated for each particular application. Many criteria can be applied to measure coating uniformity improvement. Examples include caliper standard deviation, ratio of minimum (or maximum) caliper divided by average caliper, range (which we define as the maximum caliper minus the minimum caliper over time at a fixed observation point), and reduction in void area. For example, through the use of our invention, range reductions of greater than 75% or even greater than 90% can be obtained. For discontinuous coatings (or in other words, coatings that initially have voids), our invention enables reductions in the total void area of greater than 50%, greater than 75%, greater than 90% or even greater than 99%. Those skilled in the art will recognize that the desired degree of coating uniformity improvement will depend on many factors including the type of coating, coating equipment and coating conditions, and the intended use for the coated substrate.

Through the use of our invention, 100% solids coating compositions can be converted to void-free or substantially void-free cured coatings with very low average calipers. For example, coatings having thicknesses less than 5 micrometers, less than 1 micrometer, less than 0.5 micrometer or less than 0.1 micrometer can readily be obtained. Coatings having thicknesses greater than 5 micrometers can also be obtained. In such cases it may be useful to groove, knurl, etch or otherwise texture the surfaces of one or more (or even all) of the pick-and-place devices so that they can accommodate the increased wet coating thickness.

Figure 20:
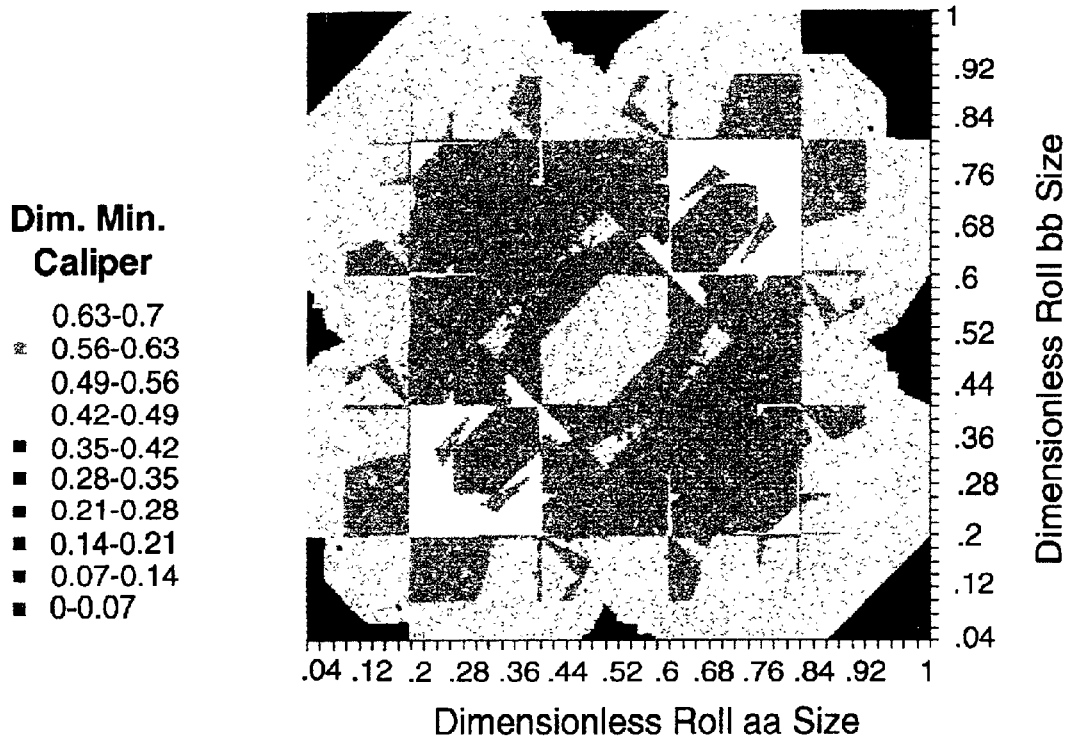
FIG. 20 is an improvement diagram showing minimum calipers that can be obtained using a periodically applied cross-web coating stripe and rolls of various sizes.
Figure 21:
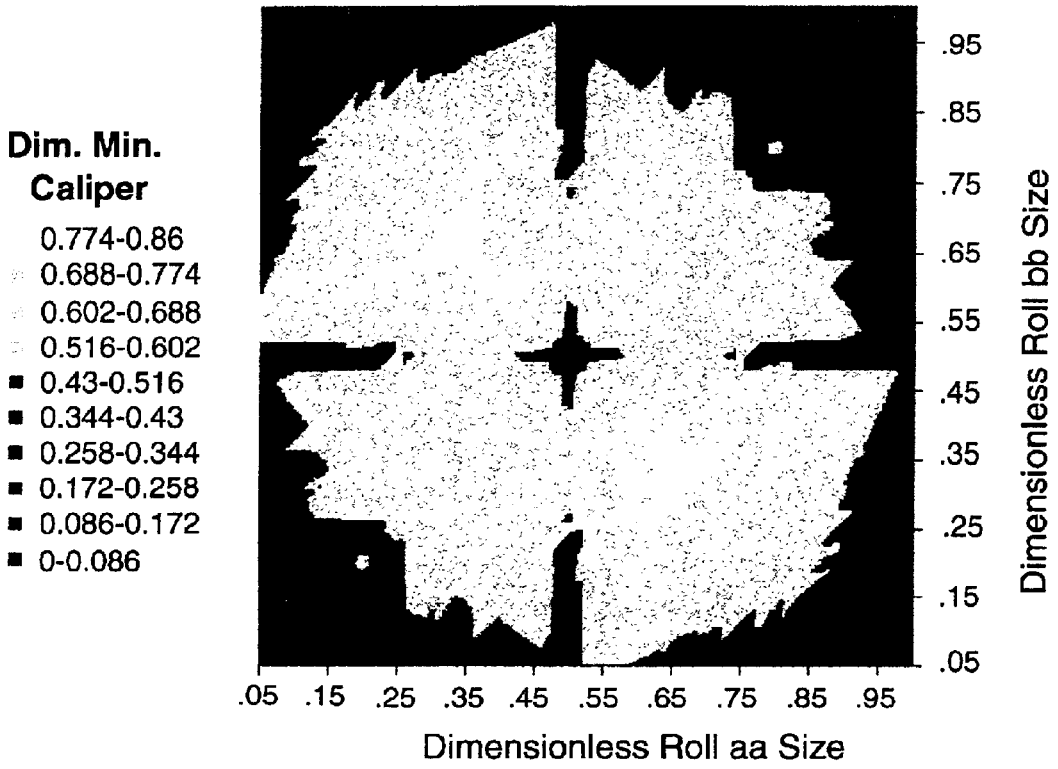
FIG. 21 is an improvement diagram showing minimum calipers that can be obtained using a periodically applied cross-web coating stripe and rolls of various sizes.
Figure 22:
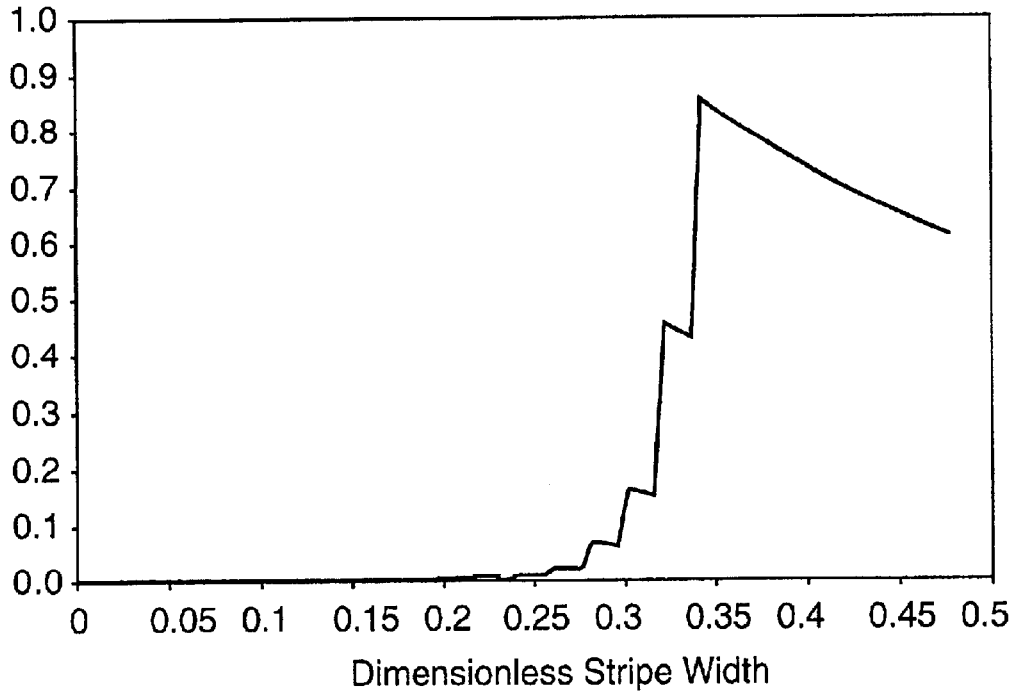
FIG. 22 is a graph showing the relationship between minimum caliper and stripe width for a web coated using a pair of rolls selected from FIG. 21.
Figure 23:
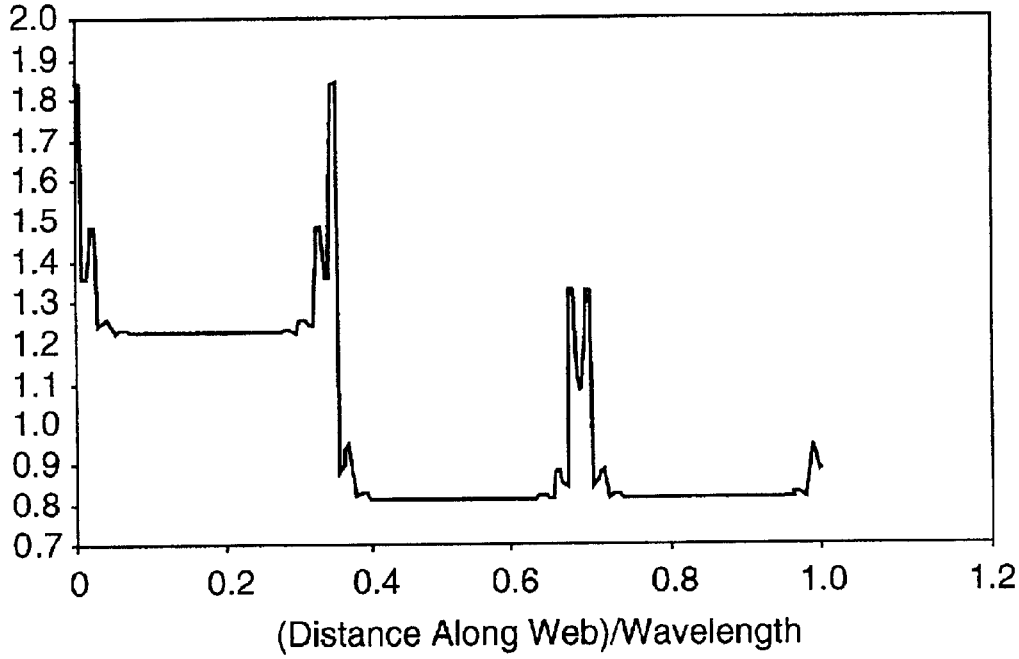
FIG. 23 is a graph showing the mean coating caliper for a web coated using a stripe selected from FIG. 22.

Further understanding of our invention can be obtained by reviewing FIG. 19 through FIG. 26. FIGS. 19 through 21 and 24 through 26 are improvement diagrams in the form of grey scale plots, and FIGS. 22 and 23 are graphs relating to FIG. 21. These improvement diagrams were prepared through extensive computer modeling of a very large number of operational modes. The improvement diagrams illustrate the influence that various parameters have upon coating continuity and caliper uniformity. The coatings are prepared from uneven initial coatings made by the application of periodic cross web stripes to a web. We based our evaluation on a uniformity metric that we designated as the "dimensionless minimum caliper", calculated as the ratio of the minimum coating caliper divided by the average caliper. Using this uniformity metric, a higher dimensionless minimum caliper corresponds to a more uniform coating.

Every point on the improvement diagrams represents the dimensionless minimum caliper obtained for a coating station/improvement station combination made according to certain fixed parameters discussed below and certain variables indicated on the abscissa and ordinate of each diagram. These variables include dimensionless roll sizes and dimensionless stripe widths. The dimensionless roll size is the time period of the roll rotation divided by the period of the input non-uniformity. If the roll size does not vary, and its surface speed equals the web speed, the dimensionless roll size is equivalent to the roll circumference divided by the non-uniformity wavelength where the wavelength is the length between successive coating stripes. In the improvement diagrams, the wavelength was assumed to be constant. The dimensionless stripe width is the stripe machine direction width divided by the wavelength, or the time for the stripe to pass an observer divided by the non-uniformity period. It is possible to apply very thick caliper stripes of coating. These will often spread into wider stripes after the first passage through a nip. The stripe width for this discussion is defined as the width immediately after the first passage through a nip.

The required dimensionless minimum caliper will depend on the particular application. For example, the requirements for coated abrasives, tape and optical films will all differ from one another. The requirements will also differ within a class of products. For example, coarse abrasives used for woodworking have a less stringent caliper uniformity requirement than microabrasives used for polishing disk drive parts. In general, the thinner the average caliper, the more stringent the uniformity requirement. As a broad generality, superior uniformity means that the minimum coating caliper (the minimum of the coating distribution) will be 90 to 100 percent of the average caliper, equivalent to a dimensionless minimum caliper of 0.9 to 1.0. The legends accompanying the improvement diagrams identify a range of dimensionless minimum caliper values assigned to each of several grey scale values. White areas on the improvement diagrams represent areas of higher dimensionless minimum caliper and darker areas represent areas of lower dimensionless minimum caliper, but the associated ranges are not the same on each improvement diagram.

Figure 19:
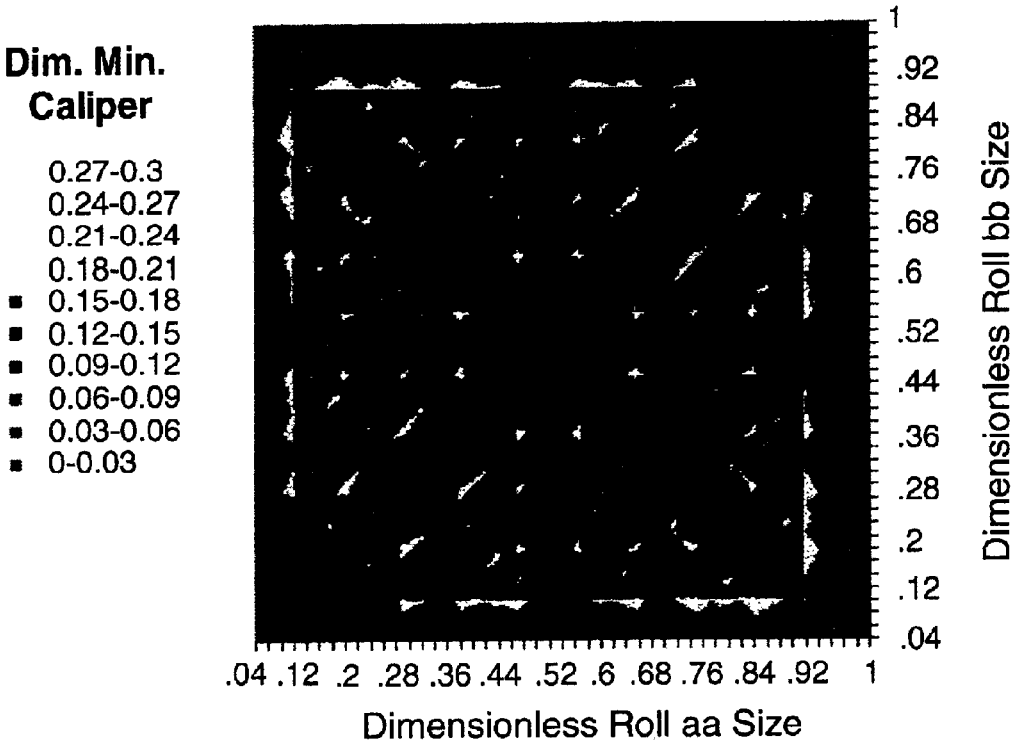
FIG. 19 is an improvement diagram showing minimum calipers that can be obtained using a periodically applied cross-web coating stripe and rolls of various sizes.

FIG. 19 is an improvement diagram showing the dimensionless minimum caliper for all combinations of roll sizes or periods for cases when only two pick and place rolls are used. These rolls are designated aa and bb. A dimensionless stripe width of 0.1 has been used in this simulation. The improvement diagram illustrates that the use of only two rolls produces very poor coating uniformity. The dimensionless minimum caliper values range from 0.0 to 0.3. For some choices of roll diameters the coating will not be continuous resulting in a minimum caliper of zero. No combinations exist that will produce an acceptable minimum caliper greater than 0.3. A dimensionless minimum near 1.0 is desired and is not achieved by any combination of parameters illustrated in FIG. 19.

FIG. 20 is an improvement diagram for a dimensionless stripe width of 0.98. Comparison of FIG. 19 and FIG. 20 shows that while wider stripe widths give an improvement in uniformity, two pick and place rolls are not sufficient to produce satisfactory uniformity for applications in which the required dimensionless minimum caliper will be greater than 0.7. A stripe width of 0.98 is equivalent to a uniform coating with a periodic void where the void length is 2% of the repeat length for the defect. Using two contacting rolls of the same size produces additional defects from the initial voids that are of smaller than average caliper. The result is a multiplication of the numbers of defects.

FIG. 21 is an improvement diagram for optimally selected dimensionless stripe widths of 0.05 to 0.475. For each pair of roll sizes the highest minimum coating caliper found for all the examined stripe widths is plotted. In other words, the optimum stripe width was used for each point on this contour plot, so the stripe width will be different at different coordinates. No combination of only two roll sizes and an optimum stripe width gave a dimensionless minimum caliper greater than 0.9. However, two rolls do allow complete coverage of the web if dimensionless stripe widths up to 0.475 are used and if the dimensionless roll sizes and dimensionless stripe width are optimally selected. FIG. 21 indicates that for a two roll improvement station, dimensionless roll sizes of 0.66 and 0.34 are a near optimum choice for maximizing the dimensionless minimum caliper. The graph in FIG. 22 shows the best dimensionless stripe width for this pair of rolls is near 0.35. It also shows that no dimensionless stripe width between 0 and 0.15 could be used to produce a dimensionless minimum caliper greater than 0.0001. This indicates that there will be functional voids in the coatings applied under such conditions. The down web coating profile for a pair of rolls with dimensionless roll sizes of 0.66 and 0.34 and a dimensionless stripe width of 0.35 is shown in the graph in FIG. 23. Complete coverage of the web is indicated and the dimensionless minimum and maximum calipers are 0.81 and 1.84. This range would be acceptable for some applications but generally would not be acceptable for applications requiring precision coating.

Figure 24:
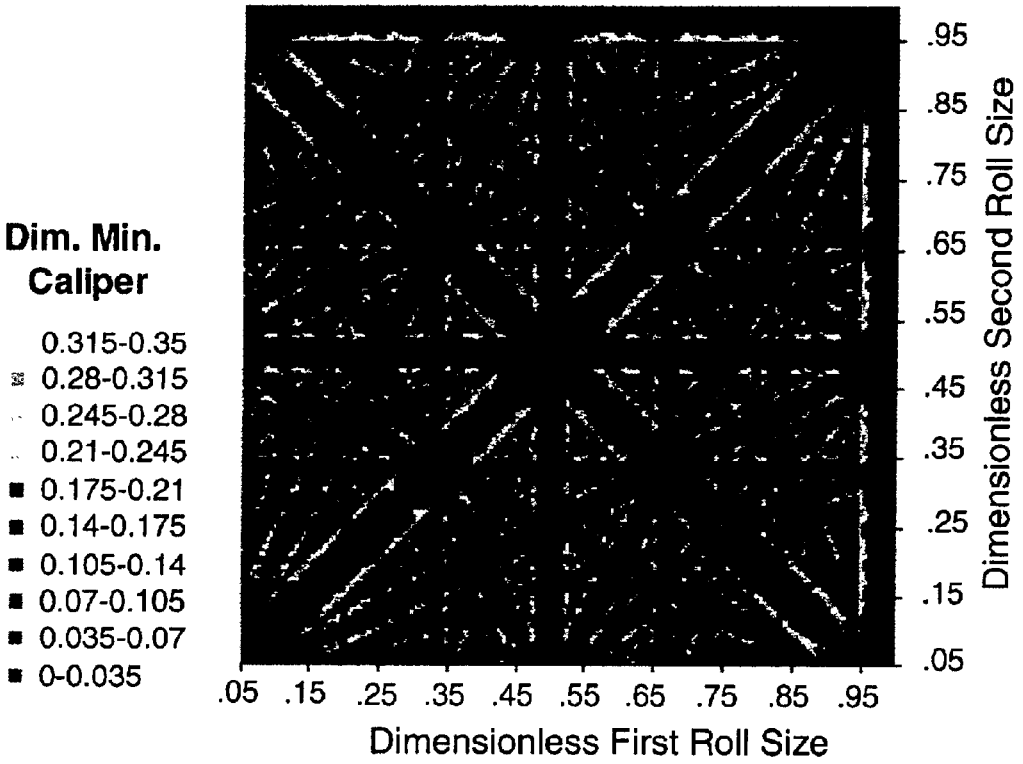
FIG. 24 is an improvement diagram showing minimum calipers that can be obtained using a periodically applied cross-web coating stripe and rolls of various sizes.
Figure 25:
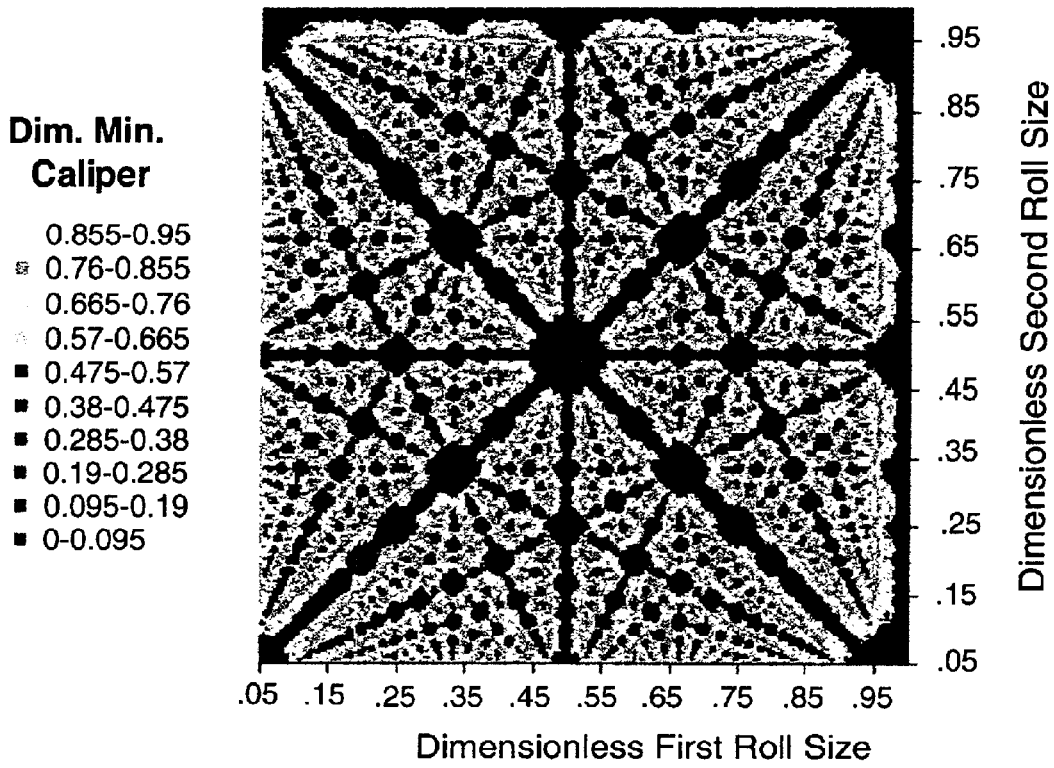
FIG. 25 is an improvement diagram showing minimum calipers that can be obtained using a periodically applied cross-web coating stripe and rolls of various sizes.

The improvement diagrams in FIG. 24 and FIG. 25 show the results using a dimensionless stripe width of 0.05 (an easily achievable width) and four rolls (FIG. 24) or ten rolls (FIG. 25) of only two different sizes. The use of four rolls is better than two rolls, and ten is better than four. The largest dimensionless minimum caliper when using ten rolls is in the range 0.855 to 0.95. The largest dimensionless minimum caliper when using four rolls is in the range 0.315 to 0.35. These improvement diagrams also illustrate that numerous pairs of roll sizes can provide poor performance.

The improvement diagrams in FIG. 19 through FIG. 21 and FIG. 24 through FIG. 26 identify combinations of roll sizes that preferentially could be used or avoided. Expressed as a first rule of thumb, we prefer to choose roll sizes that are not fractional dimensionless roll sizes ("fractional roll sizes") where the fraction is given by m/d where d is an integer less than 41 and m is any integer. Additionally, islands and bands of regions of less than the best performance are found on the improvement diagrams of FIG. 24 and FIG. 25. Islands of less than the best performance are centered about abscissa and ordinate values that equal the fractions u/v where u and v are integers generally less than 20. The size of an island is locally proportional to the lowest common denominator of the abscissa and ordinate of the island center point expressed as a fraction. Bands of less than the best performance also emanate from each axis along straight lines where the axis values are fractions. The lines are described by the family of parametric equations $y=(s/t)x+u/v$ where s, t, u, and v are all integers generally between −20 and 20 where y is the ordinate and x the abscissa. Thus expressed as a second rule of thumb, we prefer not to use pairs of roll sizes x and y that are related by the equations $y=(s/t)x+u/v$ where s, t, u, and v are all integers generally between −20 and 20. Expressed as a third rule of thumb, we prefer not to use pairs of roll sizes x and y that are equal to any intersection of the lines described by the equations $y=(s/t+u/v$ where s, t, u, and v are all integers generally between −20 and 20. If stripe width can not be controlled or is unknown, we prefer to apply each of the above-mentioned first, second and third rules of thumb.

Figure 26:
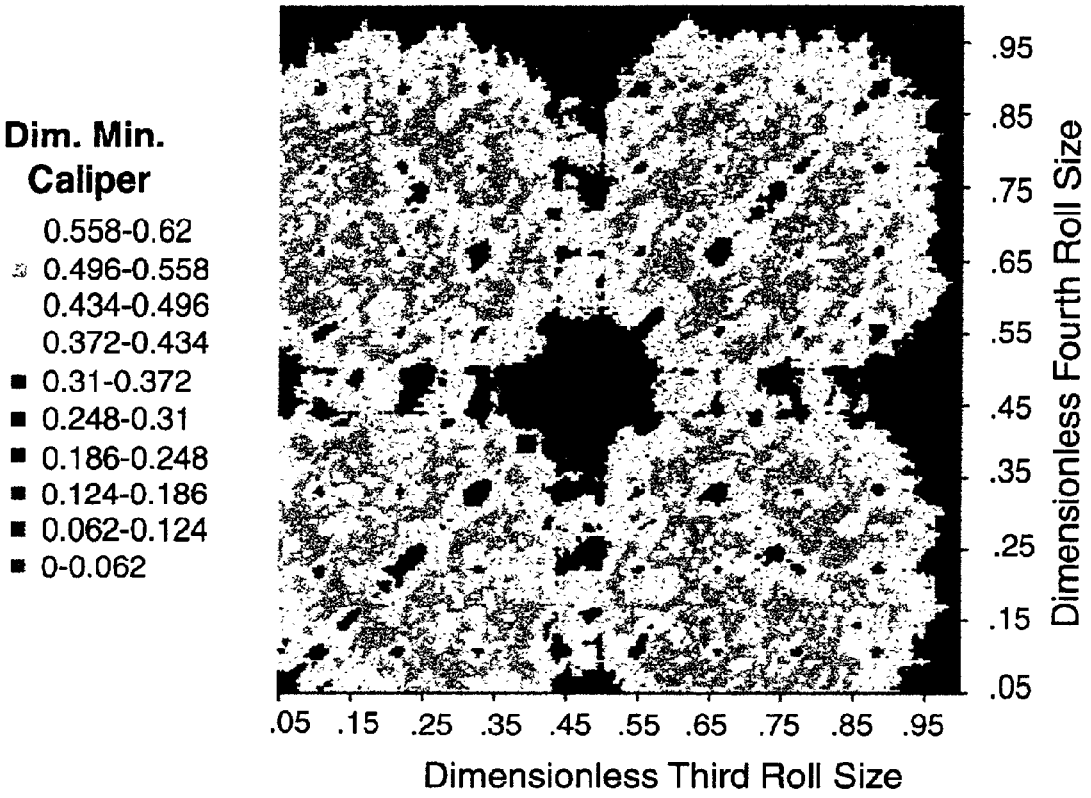
FIG. 26 is an improvement diagram showing minimum calipers that can be obtained using a periodically applied cross-web coating stripe and rolls of various sizes.

We have found that for typical industrial coating materials, easily obtainable dimensionless stripe widths generally are in the range of about 0.05 to about 0.15. For such materials and dimensionless stripe widths we prefer to use at least three rolls all of different sizes, and more preferably four or more rolls all of different sizes. FIG. 26 is an improvement diagram for an apparatus like that illustrated in FIG. 16 using four periodic pick-and-place rolls to contact the wet side of the web. A small dimensionless stripe width of 0.05 is used together with first and second contacting rolls with respective dimensionless roll sizes of 0.955 and 0.44. FIG. 26 shows the dimensionless minimum calipers for combinations of third and fourth contacting rolls with dimensionless roll sizes less than 1.0. The white regions identify choices for the third and fourth dimensionless roll sizes where the dimensionless minimum caliper will range between 0.558 and 0.62. While these regions do not represent superior caliper uniformity, the use of additional rolls can bring the dimensionless minimum caliper closer to 1.0.

We have also found by performing numerous mathematical simulations of our method that there are preferred choices of dimensionless roll sizes and dimensionless stripe widths when multiple rolls are used to spread a pattern of periodic stripes into a continuous coat. These sizes are related to the width of the stripes. If the dimensionless stripe width is represented by the symbol Y and the dimensionless roll size is represented by the symbol X, then combinations of choices of these variables can be represented by points on the rectangular plane formed on an X-Y plot between lines Y=0, Y=1, X=0, and X=1. We have found that preferred combinations are points lying in the regions between the numerous pairs of lines A and A' where A is a line described by the formula $X=mY+b$ and A' is a line described by the formula $X=m'Y+b'$. The values of the parameters m, m', b and b' are described in more detail below. Thus expressed as a fourth rule of thumb, we prefer to use roll size and stripe width combinations that lie between the lines $X=mY+b$ and $X=m'Y+b'$.

The parameter m' preferably equals 0.85 times m, and the parameter b' preferably equals b. We prefer that m and b have values that are related to certain preferred fractions. The preferred fractions are given by n/d where n and d are integers and d is less than 41 and not zero. The term n may be any integer larger than zero. The term m may have any of the values given by the relationships $m=k/(d)$ and $m=-k/(d)$, where k is an integer and can take on all values between 1 and 5. The term b is given by $b=n/d$. We also prefer that the dimensionless stripe width is greater than 0.05. Thus expressed as a fifth rule of thumb, when there is variation in the stripe period or dimensionless stripe width we prefer to use dimensionless roll size and dimensionless stripe width combinations that lie between the lines $X=0.85\ mY+b$ and $X=m'Y+b'$.

When roll sizes are chosen, our studies have found that fractional roll sizes preferably are avoided. We have also found other combinations of sizes that preferably are avoided. These lie in regions related to the fractional roll sizes between the curves S and the lines Y=0 on an X-Y plot, where the S curves are described by the formula:

$$S=hC(4000\{abs(X-n/d)\}^{Q}+1/d+2(X-n/d)\text{sign}(n/d-X))$$

where:

n/d is any fractional roll size where n is equal to or greater than zero and less than 41 and d is a positive integer between zero and 41;

h is a positive integer equal to or less than d;

Q is equal to $1+1.25\{1-(h-1)/(2h+1)\}^{h}$; and

C is equal to 1 (or 0.85 when there are random variations in the period or the width of the stripe).

Thus expressed as a sixth rule of thumb, we prefer to use roll size and stripe width combinations that lie in the regions between the curves S and the line Y=0.

As noted above, the method of the invention can employ driven pick-and-place rolls whose rotational speed is selected or varied before or during operation of the improvement station. The period of a pick-and-place roll can be varied in other ways as well. For example, the roll diameter can be changed (e.g., by inflating or deflating or otherwise expanding or shrinking the roll) while maintaining the roll's surface speed. The rolls do not have to have constant diameters; if desired they can have crowned, dished, conical or other sectional shapes. These other shapes can help vary the periods of a set of rolls. Also, the position of the rolls or the substrate path length between rolls can be varied during operation. One or more of the rolls can be positioned so that its axis of rotation is not perpendicular (or is not always perpendicular) to the substrate path. Such positioning can improve performance, because such a roll will tend to pick up coating and reapply it at a laterally displaced position on the substrate. In addition, as noted above a periodically applied coating can be fed to the improvement station and that period can be varied. All such variations are a useful substitute for or an addition to the roll sizing rules of thumb discussed above. All can be used to affect the performance of the improvement station and the uniformity of the caliper of the finished coating. For example, we have found that small variations in the relative speeds or periodicity of the devices, or between one or more of the devices and the substrate, are useful for enhancing performance. Random or controlled variations can be employed. The variation preferably is accomplished by independently driving the rolls using separate motors and varying the motor speeds. Those skilled in the art will appreciate that the speeds of rotation can also be varied in other ways, e.g., by using variable speed transmissions, belt and pulley or gear chain and sprocket systems where a pulley or sprocket diameter is changed, limited slip clutches, brakes, or rolls that are not directly driven but are instead frictionally driven by contact with another roll. Periodic and non-periodic variations can be employed. Non-periodic variations can include intermittent variations and variations based on linear ramp functions in time, random walks and other non-periodic functions. All such variations appear to be capable of improving the performance of an improvement station containing a fixed number of rolls. Improved results are obtained with speed variations having amplitudes as low as 0.5 percent of the average.

Constant speed differentials are also useful. This allows one to choose periods of rotation that avoid poor performance regions. At fixed rotational speeds these regions are preferably avoided by selecting the roll sizes.

Another aspect of our invention is that it increases the rate of drying volatile liquids on a substrate. Drying is often carried out after a substrate has been treated by washing or by passage through a treating liquid. Here the main process objective is not to apply a liquid coating, but instead to remove liquid. For example, droplets, patches or films of liquid are commonly encountered in web processing operations such as plating, coating, etching, chemical treatment, printing and slitting, as well as in the washing and cleaning of webs for use in the electronics industry.

When a liquid is placed on or is present on a substrate in the form of droplets, patches, or coatings of varying uniformity and if a dry substrate is desired, than the liquid must be removed. This removal can take place, for example, by evaporation or by converting the liquid into a solid residue or film. In industrial settings drying usually is accomplished using an oven. The time required to produce a dry web is constrained by the time required to dry the thickest caliper present. Conventional forced air ovens produce uniform heat transfer and do not provide a higher drying rate at locations of thicker caliper. Accordingly, the oven design and size must account for the highest anticipated drying load.

In typical manufacturing operations, drying can be made more difficult due to unintended but commonly occurring coating process factors such as operator mistakes, system control failures or machinery failures. These factors can cause large increases in coating caliper (e.g., by a factor of 10 or more). One typical example is a momentary loss of the hydraulic pressure that holds closed the metering gap of a reverse roll coater. Unless the drying section of a coating process line is designed with significant overcapacity, the occurrence of such a surge can cause wet web to be wound up at the end of the process line. This can make the entire wound roll unusable. In addition, if the coating liquid contains a flammable solvent, then flammable concentrations of solvent paper can arise at the winder. Since the roll winding station often causes substantial static electrical discharges, fires or explosions can occur.

The improvement stations of our invention substantially reduce the time required to produce a dry substrate, and substantially ameliorate the effect of coating caliper surges. The improvement station diminishes coating caliper surges for the reasons already explained above. Even if the coating entering the improvement station is already uniform, the improvement station greatly increases the rate of drying. Without intending to be bound by theory, we believe that the repeated contact of the wet coating with the pick-and-place devices increases the exposed liquid surface area, thereby increasing the rate of heat and mass transfer. The repeated splitting, removal and re-deposition of liquid on the substrate may also enhance the rate of drying, by increasing temperature and concentration gradients and the heat and mass transfer rate. In addition, the proximity and motion of the pick-and-place device to the wet substrate may help break up rate limiting boundary layers near the liquid surface of the wet. All of these factors appear to aid in drying. In processes involving a moving web, this enables use of smaller or shorter drying stations (e.g., drying ovens or blowers) down web from the coating station. If desired, the improvement station can extend into the drying station.

The methods and devices of the invention can be used to apply, make more uniform or dry coatings on a variety of flexible or rigid substrates, including paper, plastics, glass, metals and composite materials. The substrates can be substantially continuous (e.g., webs) or of finite length (e.g., sheets). The substrates can have a variety of surface topographies including smooth, textured, patterned, microstructured and porous surfaces (e.g., smooth films, corrugated films, prismatic optical films, electronic circuits and non-woven webs). The substrates can have a variety of uses, including tapes, membranes (e.g., fuel cell membranes), insulation, optical films or components, electronic films, components or precursors thereof, and the like. The substrates can have one layer or many layers under the coating layer.

The invention is further illustrated in the following examples, in which all parts and percentages are by weight unless otherwise indicated.

EXAMPLE 1

Using a modified coating and curing machine, a roll of cast polypropylene film was coated with an ultraviolet (UV) polymerizable epoxy silicone release coating formulation having an epoxy equivalent weight of 530 prepared like the release coating of Example 3 of U.S. Pat. No. 5,332,797. The reactive mixture contained 97 parts epoxy silicone, 2 parts bis(dodecylphenyl)iodonium hexafluoroantimonate, 3 parts ALFOL™ 1012 HA and 0.2 parts 2-isopropylthioxanthone. The polypropylene film was 50 micrometers in caliper and 152 mm wide with a matte surface finish. The coating was not applied directly to the web; instead, it was applied to an endless transfer belt as a periodic pattern of stripes. The coating on the transfer belt was made uniform by passing it through an improvement station. The thus-improved smooth, thin coating was applied to the web via a nip roll assembly. The coating was cured on the web using UV energy.

The web path ran from the unwind roll of a HIRANO MULTI COATER™ Model M-200 coating machine (Hirano Tecseed Company, Ltd.) through the nip of two driven rolls on the coating machine, through a Model 1250 UV curing station (Fusion UV Systems, Inc.) attached to the coating machine, and a web wind-up. The nip had a steel top roll and a rubber bottom roll. The UV curing station was operated at its low power setting.

The improvement station had a train of twelve undriven pick-and-place contacting rolls with diameters of 54.86, 72.85, 69.52, 62.64, 56.90, 52.53, 66.04, 39.65, 41.66, 69.09, 53.92 and 49.33 mm ±0.025 millimeters. The rolls were obtained from Webex Inc. as dynamically balanced steel live shaft rolls with chrome plated roll faces finished to 16 Ra. A silicone-rubber-covered fabric belt 152 millimeters wide and 3.05 meters long was threaded through this improvement station, around the bottom roll of the nip on the coating machine and then past a cross belt stripe application position where the release coating formulation could be applied to the belt. The belt was next threaded around a first set of five pick-and-place contacting rolls with the web path configured so as to achieve at least 45 degrees of wrap around each roll. The belt was then threaded around a MDG SERIES DISPLACEMENT GUIDE belt steering unit (Coast Controls Corp.), used to maintain precise tracking through the improvement station. From the steering unit the belt was threaded past a second set of seven pick-and-place contacting rolls using at least a 45 degree wrap around each roll, into the nip of the coating station and then back to the improvement station. The belt ends were spliced together to form an endless loop. The nip rolls were counter-rotated as a pair with surface speeds matched in the nipping region. The belt was driven by its traction with the rubber roll, and the web was driven by its traction with the steel roll.

The coating station employed an air driven cross belt oscillating mechanism that stroked a catheter needle back and forth across the belt at a rate of 48 cycles per minute. The oscillating mechanism was a Model BC406SK13.00 TOLOMATIC™ Band Cylinder (Tol-O-Matic, Inc.). The catheter needle was a 20 gauge, 32 mm long square tip needle made by Abbott Ireland. The mechanism was adjusted so that the needle tip contacted the belt as it was cycled across the belt. Two parallel interceptor plates were placed 138 mm apart above the belt and intercepting the track of the needle, in order to prevent deposition of the coating liquid along 7 mm wide lanes extending inward from each edge of the belt. A metered flow of the coating liquid was pumped to the needle so as to produce a diagonal stripe across the belt when both the needle and belt were moving. The metering pump was a gear pump with a capacity of 0.292 cubic centimeter per revolution, driven by a type QM digital metering system (both obtained from Parker Hanniford Corp.).

Using this apparatus and a web speed of 3 meters per minute, three different coating liquid flow rates were used to produce coating calipers of 0.2, 0.4 and 0.6 micrometers. The release properties of the coated samples were found to average 398, 458, and 501 grams per 2.54 centimeters of width, respectively. The standard deviations of the release properties were 19, 28, and 24 grams per 2.54 centimeters of width, respectively. This indicates that substantially void-free coatings having very good coating caliper uniformity were obtained.

EXAMPLE 2

By further modifying the coating and curing machine of Example 1, a roll of cast polyester film was coated with two silicone release materials in side-by-side abutting stripes. The coating fluid consisted of a two UV polymerizable silicone release coating compositions having different release characteristics. The first composition, a so-called "premium release" formulation, contained 55 parts by weight of RC711™ silicone and 45 parts by weight of RC726™ silicone, both sold by Goldschmidt Chemical Corp. The second composition, a so-called "medium release" formulation, contained 100 parts by, weight of RC711 silicone. To each of these compositions 3 parts by weight of DANOCUR™ 1173 curative (Ciba-Geigy Corp.) was added.

The target web was SCOTCHPAR™ polyester film (3M) having a caliper of 35.6 micrometers and a width of 152 mm. A web speed of 16.1 meters per min was used for all samples. A Model 1223 UV curing station (Fusion UV Systems, Inc.) was attached to the coating machine in place of the model 1250 station used in Example 1. The curing station was operated at its low power setting, while maintaining a nitrogen inert atmosphere with an oxygen content of less than 50 parts per million within the curing chamber.

The improvement station and transfer belt were as in Example 1. The nip was configured with a steel roll on the top and a rubber roll on bottom with no undercuts, to give 152 millimeters of nipped contact. The web was wrapped around the top steel roll of the nip, and the belt was wrapped around the bottom rubber roll. The nip rolls were counter-rotated as a pair with surface speeds matched in the nipping region. The belt was driven by its traction with the rubber roll, and the web was driven by its traction with the steel roll.

Figure 27:
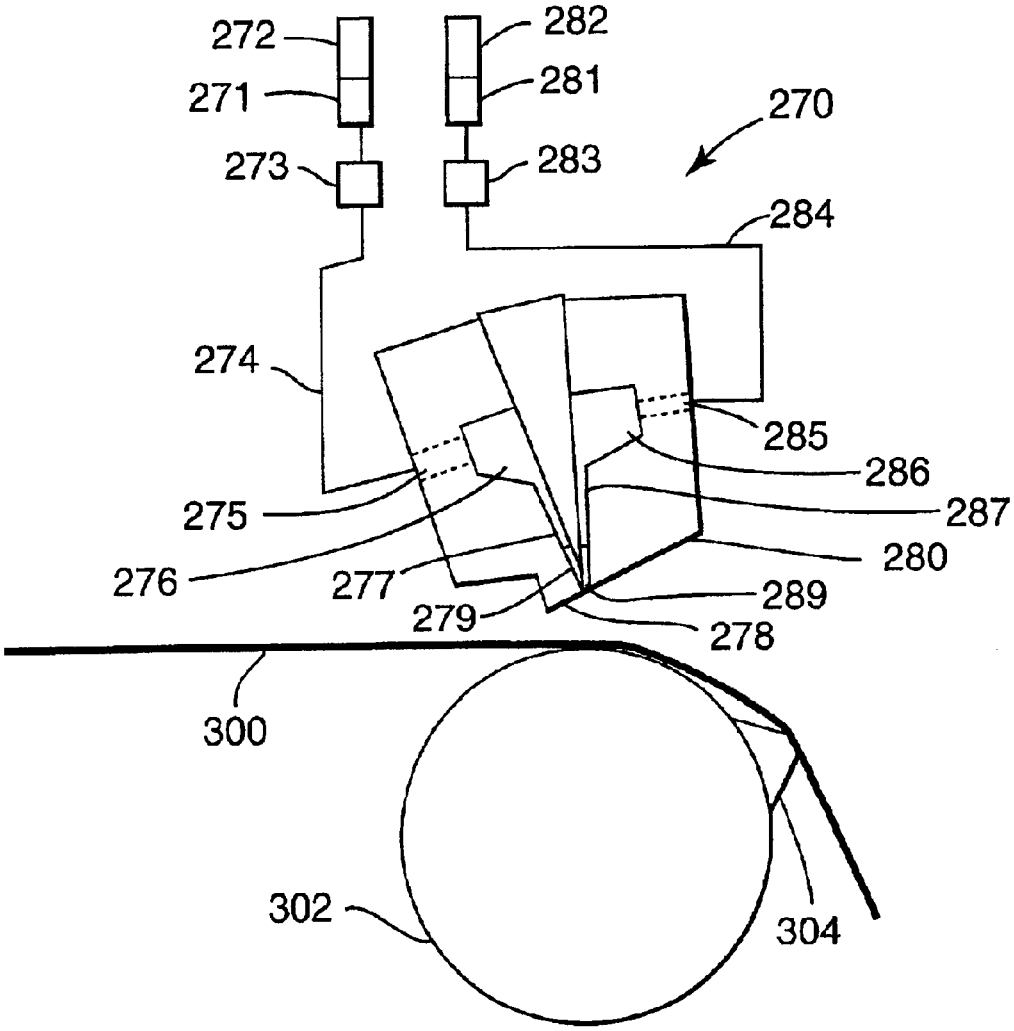
FIG. 27 is a side view of a die for coating lanes on a substrate.

The coating station employed a side-by-side dual slot applicator die 270 like that shown in FIG. 27. The first liquid coating composition 271 was fed from a reservoir 272 by a metering pump 273 through line 274 and feed port 275 to a first internal cavity 276 in die block 280. A first slot 277 allows the liquid 271 to flow out onto the die lip 278. The second composition 281 was fed from a reservoir 282 by a metering pump 283 through line 284 and feed port 285 to a second internal cavity 286 in die block 280. A second slot 287 allows the liquid 281 to flow out onto the die lip 278.

Figure 28A:
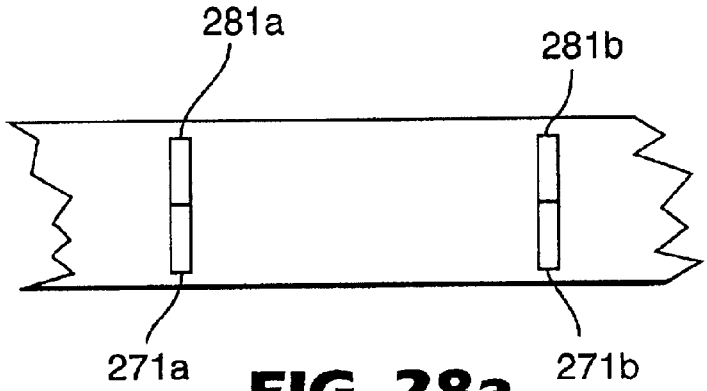
FIG. 28*a* is a top view of abutting cross web stripes on a web.
Figure 28B:
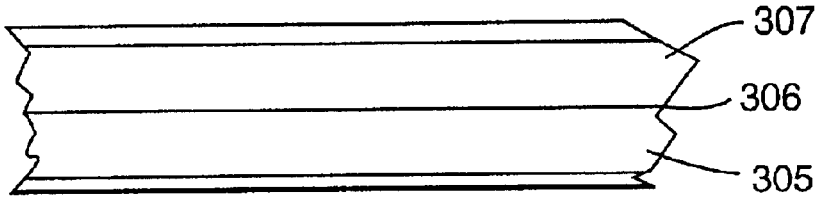
FIG. 28*b* is a top view of abutting lanes on the web of FIG. 28*a* after the web has passed through an improvement station of the invention.

The metering pumps were as in Example 1. Internal dams 279 and 289 interrupt the slots 277 and 287 so that the liquids 271 and 281 only flow onto the die lip 278 in spaced cross belt lanes defined by the absence of a dam. Liquids 271 and 281 remain on the lip until the belt 300 contacts them. The belt translates on roll 301 past and under die 270. On the circumference of roll 302 along its axis is mounted a bump pad 304. The bump pad was a foam block 3 mm high and 6 mm wide. On each revolution of roll 302 the bump pad lifts the belt 300 into contact with the liquids on the die lip 278. The internal dams 279 and 289 were adjusted to provide spaced lanes of the first and second compositions that are just abutting. As shown in FIG. 28*a*, that will enable application of cross belt stripes 271*a* and 271*b* of the first composition and cross belt stripes 281*a* and 281*b* of the second composition to belt 300. As shown in FIG. 28*b*, when the thus-coated belt 300 is passed through the improvement station, abutting stripes 305 and 307 can be formed. Two flow rates were used to produce coating calipers of 0.3 and 0.5 micrometers at 16 meters per minute. Each stripe 305 and 307 contains only the composition 271 or 281 applied initially from the respective die slot 277 or 287. There is no significant intermixing of the respective compositions 271 and 281 at the mating line 306 between the lanes. Purposeful oscillation of the belt tracking by the belt steering device can be used to produce mating line mixing if desired. The caliper of each lane is controlled by flow rates of the metering pumps 273 and 283, which in turn control the flow of liquid into the cavities 276 and 286, and the flow from the slots 277 and 287.

Figure 29A:
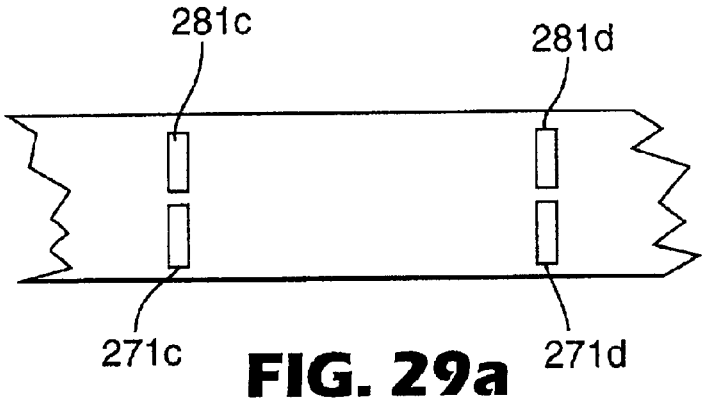
FIG. 29*a* is a top view of separated cross web stripes on a web.
Figure 29B:
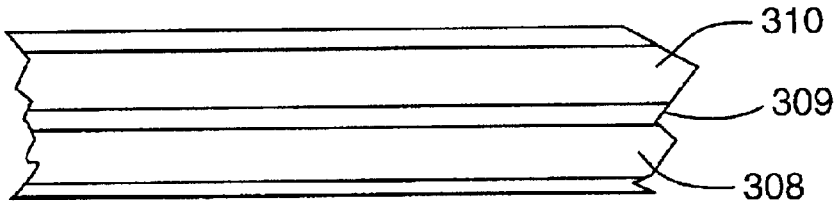
FIG. 29*b* is a top view of lanes on the web of FIG. 29*a* after the web has passed through an improvement station of the invention.

As shown in FIG. 29*a*, dams 279 and 289 can also be adjusted to provide cross belt stripes that are not abutting on belt 300. As shown in FIG. 29*b*, when the thus-coated belt 300 is passed through the improvement station, abutting stripes 308 and 310 can be formed with a sharply defined uncoated lane 309 between stripes 308 and 310.

We found it both useful and unexpected to be able to apply lanes with controllable caliper and good edge definition, and to be able to apply abutting lanes of different formulations without intermixing between the lanes. Without intending to be bound by theory, we believe this was made possible because we were able to apply metered amounts of the liquids without any excess. This enabled us to avoid the creation of rolling banks of excess liquid. The elimination of these rolling banks may have prevented intermingling. This lack of intermixing is a significant advantage, and difficult to obtain using conventional coating devices. We believe that we obtain this unexpected result because the forces that dominate the flow of liquid are aligned with the belt length direction, and minimal or no cross belt forces appear to be generated.

EXAMPLE 3

The coating apparatus of Example 1 was modified by removing the belt and threading the web so that the web directly contacted a train of 13 improvement rolls. The pick-and-place rolls had respective diameters of 5.245, 5.321, 5.398, 5.474, 5.550, 5.626, 5.702, 5.779, 5.855, 5.931, 6.007, 6.083 and 6.160 mm. The apparatus was used to apply a UV curable primer to a 30.5 mm wide, 50 micrometer caliper polyimide film (commercially available from E. I. duPont de Nemours and Co.) traveling at 3 meters per minute. The coating station employed an oscillating needle applicator having a 0.094 mm inside diameter, for application of the primer liquid directly onto the moving polyimide web. The needle oscillated across the web at a rate of one cycle per 2 seconds. The needle could also be used to apply the primer liquid to an intermediate co-rotating transfer roll having a 76 mm diameter. The transfer roll helped to avoid coating beyond the edge of the web, and lessened the chance of the primer liquid going onto the backside of the web. Using either application technique, stripe patterns were initially deposited on the web. The primer liquid was pumped to the applicator at a mass flow rate sufficient to achieve a final uniform wet caliper of 1 micrometer on the web. The resulting coating formed a continuous primer layer on the substrate.

EXAMPLE 4

A coating apparatus including an 8 roll improvement station was constructed to apply a UV curable release coating to a 30.5 cm wide, 23.4 micrometer caliper polyester (PET) tape backing. The coating apparatus employed an electrospray coating head as described in U.S. Pat. No. 5,326,598 and a restricted flow die as described in U.S. Pat. No. 5,702,527, mounted above a large, free-rotating grounded metal drum. The drum diameter was 50.8 cm and its width was 61 cm. The die wire was held at a fixed distance of 10.8 cm from the surface of the drum, and at an electrical potential of minus 40,000 volts with respect to ground. The die was 33 cm wide. Due to charge repulsion of the drops within the liquid mist generated by the die, the die was capable of spraying a 38-cm wide mist across the drum.

The moving PET web was brought from an unwind roll and wrapped over the grounded metal drum. The web was pre-charged on the drum just prior to the electrospray coating die using a series of 3 corotron corona chargers to provide a positive potential of at least 1000 volts as measured by an electrostatic voltmeter positioned 1 cm above the web and grounded drum. The web then passed under the electrospray coating die where negatively charged droplets generated at the die were electrostatically attracted to the web. The droplets landed on the web apart from each other and then started to spread in order eventually to form a continuous coating. During this drop spreading time a spot on the web was being moved from the grounded drum a distance of 1.45 m into a UV curing station where the liquid coating was cured to form a solid coating. If the web travels too quickly from the coating station to the cure station then complete drop spreading will not occur and the cured web coating will be in the form of discrete spots or a discontinuous film with many voids, rather than a continuous film. The uncoated areas present a bare substrate surface that will not have good adhesive release properties.

Between the coating and the curing stations at a path length 0.86 m from the application of the spray mist to the web was placed an improvement station containing 8 pick-and-place rolls arranged in a compact tortuous path having a length of 1.14 m. The rolls had respective diameters of 54.86, 69.52, 39.65, 56.90, 41.66, 72.85, 66.04, and 52.53 mm, all with a tolerance of plus or minus 0.025 mm.

The PET web was run through the coating apparatus at line speeds of 15.24, 30.48, 60.96 and 121.92 n/min, each speed being double the previous speed. A solventless silicone acrylate UV curable release formulation as described in Example 10 of U.S. Pat. No. 5,858,545 was prepared and pumped into the die. The flow rate to the die was held fixed at 5.81 cc/min to produce various decreasing coating heights as the web speed increased. Since the flow rate was held constant, this meant that the drops would have to spread farther as the coating became thinner. In a first set of runs, the PET web was coated beneath the die and then fed directly into the UV curing station without passing through the improvement station. In a second set of runs, the PET web was coated beneath the die, fed through the 8 roll improvement station and then fed into the UV curing station. In both sets of runs the web was wound up on a take-up roll after passing through the UV curing station. The power to the UV curing station was held constant for all runs. The UV-C (250–260 nm) energy density or dose was measured using an EIT UVIMAP Model No. UM254L-S UV dosimeter (Electronic Instrumentation and Technology, Inc.). At a web speed of 15.24 m/min, the dose was 32 mJ/cm$^2$. Each time the web speed was doubled, the UV-C dose was effectively halved, so that at a web speed of 121.92 m/min, the UV-C dose was 4 mJ/cm$^2$. The UV dose was sufficient to cure the coating for all runs.

The coated and cured web was unwound and samples removed for an adhesive peel test, in order to evaluate the release properties of the cured coating produced in each run. A standard 180° peel test was performed at a peel rate of 0.23 m/min using SCOTCH™845 acrylic book tape and an IMASS™ Model 3M90 slip/peel tester (Imass, Inc.). A 2.04 kg weight was rolled twice back and forth over the tape, followed by 3 days aging at room temperature prior to tape removal. When the pieces of peel test tape used for the 180° peel test were re-applied to a clean glass substrate and then removed, no drop in the re-adhesion values was observed for any of the pieces of peel test tape, indicating that all samples had been completely cured. Set out below in Table I are the run number, web speed, the calculated cured coating thickness, the number of improvement rollers, and the measured initial release force obtained using the 180° peel test.

TABLE I

| Run No. | Web Speed, m/min | Cured Coating Average Thickness, μm | Number Of Rollers | Initial Release, g/2.54 cm of width |
|---|---|---|---|---|
| 4-1 | 15.24 | 1 | 0 | 44.4 |
| 4-2 | 30.48 | 0.5 | 0 | 56.1 |
| 4-3 | 60.96 | 0.25 | 0 | 117.2 |
| 4-4 | 121.92 | 0.125 | 0 | 611.4 |
| 4-5 | 15.24 | 1 | 8 | 48.9 |
| 4-6 | 30.48 | 0.5 | 8 | 44.6 |
| 4-7 | 60.96 | 0.25 | 8 | 50.5 |
| 4-8 | 121.92 | 0.125 | 8 | 77.1 |

As shown in Table I, when no pick-and-place rollers were used, the release force values increased with increasing web speed. More than an order of magnitude increase was observed, with the rate of increase being especially noticeable at web speeds above 30 m/min. This indicates that the drops had not fully spread at these higher web speeds and that the cured coating contained significant void areas. When the improvement station and its train of 8 pick-and-place rolls was employed between the coating die and the UV curing station, then the release force values did not significantly increase as the web speed increased. Solventless thin-film coatings with calipers below 1 micrometer are very difficult to achieve. The results shown above demonstrate that substantial improvements in the coating uniformity of these very thin coatings can be achieved using the present invention.

EXAMPLE 5

A coating and drying apparatus was constructed to coat and dry a web of 37.5 micrometer caliper film. The apparatus had a 4 roll improvement station with undriven steel pick-and-place rolls having respective diameters of 48.48, 39.91, 52.12 and 55.12 mm. The drying station had four HEPA air filtration units mounted 152 mm above the web, and providing air at 22° C. and 8.5% RH. The coating station was a small hypodermic needle attached to a HARVARD™ syringe pump (commercially available from Harvard Instruments, Inc.), set to deliver 0.01 ml of distilled water per minute to the web in drops having a volume of 0.0009 ml.

The contact angle of the water on the pick-and-place rolls was less than 45°. By wrapping the rolls with a pressure-sensitive tape having a low adhesion backsize coating, the contact angle of water on the rolls could be increased to over 90°.

In a control run, the improvement station was removed, and water was deposited on the moving web using the syringe and followed until it reached the middle of the drying station. The web was stopped and the time required to complete drying was noted by visual examination. The drying time was 45 minutes.

In a series of runs, the web was operated at various line speeds while using the improvement station, and with and without wrapping the pick-and-place rolls with tape. The drying time was noted, and the ratio of drying times with and without the improvement station was recorded. Set out below in Table II are the run number, web speed, whether or not the rolls were wrapped with tape, and the ratio of the control drying time to the drying time using the improvement station.

TABLE II

| Run No. | Web Speed, m/min | Roll Surface Wrapped with Tape? | Ratio of Drying Time without Improvement Station:with Improvement Station |
|---|---|---|---|
| 5-1 | 4.57 | No | >109.7 |
| 5-2 | 5.18 | No | >109.7 |
| 5-3 | 6.40 | No | >109.7 |
| 5-4 | 13.1 | No | 71.4 |
| 5-5 | 13.1 | Yes | 3.0 |

As shown in Table II, use of the improvement station provided a dramatic increase in drying rate. When the rolls were not wrapped with tape, patches of the liquid were observed on the wet the rolls, and an over 70-fold improvement in drying rate was observed.

Various modifications and alterations of this invention will be apparent to those skilled in the art without departing from the scope and spirit of this invention. This invention should not be restricted to that which has been set forth herein only for illustrative purposes.

We claim:

1. A method for improving the uniformity of a wet coating on a substrate having a direction of motion comprising contacting the wet coating at a first position with wetted surface portions of:

a) two or more pick-and-place devices that rotate or translate in the direction of motion, or b) four or more pick-and-place devices that rotate or translate counter to the direction of motion and re-contacting the wet coating with such wetted surface portions at positions on the substrate whose lengths along the substrate with respect to the first position are not the same.

2. A method according to claim 1 wherein at least one of the pick-and-place devices comprises a roll.

3. A method according to claim 2 comprising three or more pick-and-place rolls that rotate in the direction of motion.

4. A method according to claim 3 wherein three or more of the rolls have different diameters.

5. A method according to claim 2 wherein the substrate comprises a rotating endless belt or moving web, and the rolls are carried with the belt or web in its motion.

6. A method for improving the uniformity of a wet coating on a substrate comprising contacting the coating at a first position with wetted surface portions of:

a) three or more periodic pick-and-place devices that are not pexiodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein the substrate comprises a rotating endless belt or moving web, at least one of the pick-and-place devices comprises a roll, at least one of the rolls is undriven and the rolls rotate with the belt or web.

7. A method for improving the uniformity of a wet coating on a substrate comprising contacting the coating at a first position with wetted surface portions of:

a) three or more periodic pick-and-place devices that are not periodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein the substrate comprises a rotating endless belt or moving web, at least one of the pick-and-place devices comprises a roll, all of the rolls are undriven and the rolls rotate with the belt or web.

8. A method according to claim 5 comprising at least four pick-and-place devices.

9. A method according to claim 2 comprising at least five pick-and-place devices.

10. A method according to claim 2 wherein there is a speed differential between the substrate and at least one roll.

11. A method according to claim 10 wherein there are speed differentials between the substrate and two or more rolls.

12. A method for improving the uniformity of a wet coating on a substrate comprising contacting the coating at a first position with wetted surface portions of:

a) three or more periodic pick-and-place devices that are not periodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein at least one of the pick-and-place devices comprises a roll and there is a periodic speed differential between the substrate and at least one roll.

13. A method for improving the uniformity of a wet coating on a substrate comprising contacting the coating at a first position with wetted surface portions of:

a) three or more periodic pick-and-place devices that are not periodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein at least one of the pick-and-place devices comprises a roll and there is a sinusoidal speed differential between the substrate and two or more rolls.

14. A method according to claim 13 wherein two of the speed differentials have opposite signs for a portion of time.

15. A method according to claim 14 wherein the two speed differentials are periodic and out of phase with one another.

16. A method according to claim 15 wherein the two speed differentials are out of phase by 180 degrees.

17. A method according to claim 1 wherein the pick-and-place devices have contacting periods that are chosen so as to produce a coating having improved uniformity.

18. A method for improving the uniformity of a wet coating on a substrate comprising contacting the coating at a first position with wetted surface portions of:

a) three or more periodic pick-and-place devices that are not periodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein the pick-and-place devices have contacting periods that are chosen so as to produce a coating having improved uniformity and the period of at least one pick and place device can be changed while the device is in operation.

19. A method according to claim 18 wherein the period is changed by changing the rotational speed of a pick-and-place roll.

20. A method according to claim 18 wherein the period is changed by changing the diameter of a pick-and-place roll.

21. A method according to claim 18 wherein the period is changed in response to a control signal from a control system.

22. A method according to claim 18 wherein the period is changed in response to a signal from a caliper sensing device.

23. A method for applying a coating to a substrate having a direction of motion comprising deliberately applying to the substrate an uneven wet coating, contacting the wet coating at a first position with wetted surface portions of:

a) two or more pick-and-place devices that rotate or translate in the direction of motion, or b) four or more pick-and-place devices that rotate or translate counter to the direction of motion and re-contacting the wet coating with such wetted surface portions at positions on the substrate whose lengths along the substrate with respect to the first position are not the same.

24. A method according to claim 23 wherein the uneven coating is discontinuously applied.

25. A method according to claim 23 wherein the uneven coating is applied by spraying.

26. A method according to claim 23 wherein the applied coating initially has voids.

27. A method according to claim 23 wherein the uneven coating is applied in stripes transverse to the direction of motion.

28. A method according to claim 23 wherein the uneven coating is applied to a substrate that has already been wet by a previously applied layer of the coating.

29. A method according to claim 23 wherein the uneven coating is applied to a dry substrate and the applied coating initially has voids.

30. A method according to claim 23 wherein the uneven coating has periodically repeated voids in the direction of motion.

31. A method for applying a coating to a substrate comprising applying to the substrate an uneven wet coating, contacting the coating at a first position with wetted surface portions of:

a) three or more periodic pick-and-place devices that are not periodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein the uneven coating is periodically applied and the period of the applied coating is changed in response to a control signal from a caliper sensing device.

32. A method according to claim 23 wherein the substrate comprises a roll, endless belt or moving web having a direction of motion.

33. A method according to claim 32 wherein the applied coating initially has a thickness that varies in the direction of motion.

34. A method scoording to claim 33 wherein the thickness has a periodic variation.

35. A method according to claim 34 wherein the period varies with time.

36. A method according to claim 32 wherein the applied coating thickness is initially discontinuous in the direction of motion.

37. A method according to claim 32 wherein the coating is applied from one or more nozzles at least one of which traverses the substrate in a direction other than the direction of motion.

38. A method according to claim 23 wherein the average coating thickness can be premetered.

39. A method according to claim 23 wherein the substrate comprises a transfer belt or transfer roll, the pick-and-place devices comprise rolls, and a moving web is contacted by a coated portion of the transfer belt or transfer roll whereby a portion of the coating is transferred to the web.

40. A method according to claim 39 wherein the applied coating initially has voids.

41. A method according to claim 40 wherein the transferred coating is substantially void-free.

42. A method for applying a coating to a substrate comprising applying to the substrate an uneven wet coating, contacting the coating at a first position with wetted surface portions of:

a) three or more periodic pick-and-place devices that are not periodically related, or b) two or more rotating pick-and-place devices having the same direction of rotation and re-contacting the coating with such wetted surface portions at positions on the substrate that are different from the first position and not periodically related to one another with respect to their distance from the first position, wherein the substrate comprises a transfer belt or transfer roll, the pick-and-place devices comprise rolls, a moving web is contacted by a coated portion of the transfer belt or transfer roll whereby a portion of the coating is transferred to the web, and the transfer belt period or transfer roll period end the period of at least one of the pick-and-place rolls are not related as integer multiples of one another.

43. A method according to claim 39 wherein the periods of at least two pairs of the pick-and-place rolls are not related as integer multiples of one another.

44. A method according to claim 39 wherein the uneven coating is periodically applied.

45. A method for applying a coating to a substrate comprising applying to the substrate an uneven wet coating, contacting the coating at a first position with wetted surface portions of:

a) three or more periodic pick-and-place devices that are not periodically b) two or more rotating periodic pick-and-place devices having the same direction of rotation and re-contacting the coating with such wetted surface portions at positions on the substrate that are different from the first position and not periodically related to one another with respect to their distance from the first position, wherein the substrate comprises a transfer belt or transfer roll, the pick-and-place devices comprise rolls, a moving web is contacted by a coated portion of the transfer belt or transfer roll whereby a portion of the coating is transferred to the web, the uneven coating is periodically applied and the period of the coating applicator and the period of at least one of the pick-and-place rolls can not be expressed by a fraction where the numerators and the denominators are integers ranging from one to twenty.

46. A method for applying a coating to a substrate comprising applying to the substrate an uneven wet coating, contacting the coating at a first position with wetted surface portions of:

a) three or more periodic pick-and-place devices that are not periodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein the substrate comprises a transfer belt or transfer roll, the pick-and-place devices comprise rolls, a moving web is contacted by a coated portion of the transfer belt or transfer roll whereby a portion of the coating is transferred to the web, the uneven coating is periodically applied, the coating is applied as one or more stripes, the pick-and-place devices comprise rolls, and at least two of the roll periods are not related as "fractional roll sizes" where the fraction is given by m/d where m and d are integers and d is less than 41.

47. A method according to claim 46 wherein at least one pair of rolls with sizes x and y are not related by the equations $y=(s/t)x+u/v$ where s, t, u, and v are all integers between −20 and 20.

48. A method according to claim 46 wherein at least one pair of rolls with sizes x and y are not related to any intersection of the lines described by the equations $y=(s/t)x+u/v$ where s, t, u, and v are all integers generally between −20 end 20.

49. A method according to claim 23 wherein the coating is applied in one or more lanes.

50. A method according to claim 49 wherein the coating is applied in two or more abutting lanes.

51. A method according to claim 23 comprising the further step of drying the coating, wherein the pick-and-place devices increase the rate of drying.

52. A method according to claim 1 comprising the further step of drying the coating, wherein the pick-and-place devices increase the rate of drying.

53. A method according to claim 1 wherein the coating initially has a maximum caliper, a minimum caliper, and a caliper range equal to the maximum caliper minus the minimum caliper, and wherein the pick-and-place devices reduce the range by greater than 75%.

54. A method according to claim 53 wherein the pick-and-place devices reduce the range by greater than 90%.

55. A method according to claim 1 wherein the coating initially has voids, and wherein the pick-and-place devices reduce the total void area by greater than 50%.

56. A method according to claim 55 wherein the pick-and-place devices reduce the total void area by greater than 75%.

57. A method according to claim 55 wherein the pick-and-place devices reduce the total void area by greater than 99%.

58. A method for improving the uniformity of a wet coating on a substrate comprising contacting the coating at a first position with wetted surface portions of:

a) three or more periodic pick-and-place devices that are not periodically related, or b) two or more rotating periodic pick-and-place devices having the same direction of rotation and re-contacting the coating with such wetted surface portions at positions on the substrate that are different from the first position and not periodically related to one another with respect to their distance from the first position, wherein the surface portions of one or more of the pick-and-place devices are grooved, knurled, etched or otherwise textured.

59. A method according to claim 1 wherein the coating is dried, cured or otherwise hardened, and has a final coating caliper less than about 5 micrometers.

60. A method according to claim 59 wherein the final coating caliper is less than about 1 micrometer.

61. A method according to claim 59 wherein the final coating caliper is less than about 0.5 micrometer.

62. A method according to claim 59 wherein the final coating caliper is less than about 0.1 micrometer.

* * * * *

UNITED STATES PATENT AND TRADEMARK OFFICE

CERTIFICATE OF CORRECTION

PATENT NO. : 6,737,113 B2
DATED : May 18, 2004
INVENTOR(S) : Leonard, William K.

It is certified that error appears in the above-identified patent and that said Letters Patent is hereby corrected as shown below:

Column 2,
Line 16, "centers" should be shown as -- coaters --

Column 13,
Line 5, "coaxing" should be shown as -- coating --

Column 18,
Line 6, "y=(s/t+u/v" should be shown as -- y=(s/t)x + u/v --

Signed and Sealed this

Thirtieth Day of November, 2004

JON W. DUDAS
*Director of the United States Patent and Trademark Office*